US011828296B2

(12) United States Patent
Lim

(10) Patent No.: US 11,828,296 B2
(45) Date of Patent: Nov. 28, 2023

(54) MOTOR ASSEMBLY

(71) Applicant: LG Electronics Inc., Seoul (KR)

(72) Inventor: Jinsub Lim, Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 17/974,161

(22) Filed: Oct. 26, 2022

(65) Prior Publication Data

US 2023/0184260 A1 Jun. 15, 2023

(30) Foreign Application Priority Data

Dec. 9, 2021 (KR) ..... 10-2021-0176070

(51) Int. Cl.

| | |
|---|---|
| ***F04D 29/44*** | (2006.01) |
| ***F04D 17/06*** | (2006.01) |
| ***F04D 25/06*** | (2006.01) |
| ***F04D 29/58*** | (2006.01) |
| ***F04D 29/62*** | (2006.01) |

(52) U.S. Cl.

CPC ..... *F04D 29/444* (2013.01); *F04D 17/06* (2013.01); *F04D 25/0653* (2013.01); *F04D 29/5806* (2013.01); *F04D 29/5853* (2013.01); *F04D 29/624* (2013.01)

(58) Field of Classification Search

CPC ..... F04D 17/06; F04D 17/08; F04D 17/165; F04D 25/06; F04D 25/0653; F04D 25/08; F04D 25/082; F04D 29/444; F04D 29/54; F04D 29/541; F04D 29/542; F04D 29/5806; F04D 29/5853; F04D 29/624

See application file for complete search history.

(56) References Cited

U.S. PATENT DOCUMENTS

| | | | | |
|---|---|---|---|---|
| 11,085,454 | B2 * | 8/2021 | Lee | A47L 5/22 |
| 11,297,989 | B2 * | 4/2022 | Park | A47L 9/22 |
| 2021/0235951 | A1 | 8/2021 | Hwang et al. | |

FOREIGN PATENT DOCUMENTS

| | | |
|---|---|---|
| CN | 111520365 | 8/2020 |
| EP | 3376043 | 9/2018 |
| KR | 20110048796 | 5/2011 |
| KR | 20130005653 | 1/2013 |
| KR | 10-2021-0142444 | 11/2021 |
| WO | WO 2021/084875 | 5/2021 |

OTHER PUBLICATIONS

Extended European Search Report in European Appln. No. 22202929.0, dated Apr. 28, 2023, 7 pages.

* cited by examiner

*Primary Examiner* — Brian O Peters
(74) *Attorney, Agent, or Firm* — Fish & Richardson P.C.

(57) ABSTRACT

A motor assembly includes an impeller, a first diffuser at a downstream side of the impeller, a second diffuser at a downstream side of the first diffuser, an impeller cover coupled to the second diffuser and accommodating the impeller and the first diffuser, and a motor provided at the downstream side of the second diffuser to drive the impeller. The second diffuser includes a hub, an outer wall concentrically disposed outside the hub, and a plurality of blades having one side connected to the hub and the other side connected to the outer wall. The impeller cover is coupled to the outer wall of the second diffuser. A communicating portion for allowing fluid communication between inside and outside of the hub of the second diffuser is provided at the hub of the second diffuser.

25 Claims, 21 Drawing Sheets

MOTOR ASSEMBLY

CROSS-REFERENCE TO RELATED APPLICATION

Pursuant to 35 U.S.C. § 119(a), this application claims the benefit of the earlier filing date and the right of priority to Korean Patent Application No. 10-2021-0176070, filed on Dec. 9, 2021, the contents of which are incorporated by reference herein in their entirety.

TECHNICAL FIELD

This disclosure relates to a motor assembly.

BACKGROUND

A motor is a device that converts electrical energy into mechanical energy. The motor generally includes a stator and a rotor rotatably disposed with a predetermined gap (e.g., air gap) with respect to the stator. The size and weight of the motor vary depending on an intended use.

Some motors include a motor assembly having an impeller to generate a pressure during rotation or to promote the movement of air. However, in a motor assembly having an impeller, the air volume may be reduced if the sizes of the stator and the rotor are reduced.

In a motor assembly having an impeller, when the sizes of the stator and the rotor are reduced, a method of increasing the number of rotations of the rotor may be used to maintain the air volume. However, when the number of rotations of the impeller and the rotor is increased, a temperature of the stator and the rotor may be excessively increased.

In addition, when the number of rotations of the impeller and the rotor is increased, the amount of displacement of a bearing that supports a rotating shaft increases as much, thereby shortening the life of the bearing.

In addition, when the number of rotations of the impeller and the rotor is increased, the bearing strength for supporting the rotating shaft of the rotor is further reduced due to the size reduction of the stator and the rotor, thereby increasing the wear of the bearing.

In addition, if a portion of the air passing through the impeller is moved toward the stator and the rotor to cool the stator and the rotor, the air flow resistance may increase, thereby degrading power and efficiency of the motor.

SUMMARY

The present disclosure describes a motor assembly capable of discharging heated air to the outside of a diffuser.

The present disclosure also describes a motor assembly capable of restricting the occurrence of vibration of a bearing.

The present disclosure also describes a motor assembly capable of accelerating cooling of a bearing.

The present disclosure also describes a motor assembly capable of increasing a heat exchange area of a bearing.

In order to achieve these and other advantages and in accordance with the purpose of this specification, as embodied and broadly described herein, there is provided a motor assembly including a first diffuser and a second diffuser provided at a downstream side of an impeller, and a communicating portion provided at a hub of the second diffuser and allowing the inside and the outside of the hub of the second diffuser to fluidly communicate with each other.

For example, the first diffuser and the second diffuser may be provided at a downstream side along an axial direction of the impeller, a motor may be provided at a downstream side of the second diffuser, and the communicating portion, which is configured to allow the inside the outside of the hub of the second diffuser to be in fluid communication with each other, may be provided at the second diffuser. Therefore, air inside the hub of the second diffuser heated by the motor may be discharged to the outside of the second diffuser through the communicating portion.

In some implementations, an impeller cover may be provided outside the impeller and the first diffuser. A downstream end of the impeller cover may be coupled to an outer wall of the second diffuser.

According to this configuration, an air flow path having a relatively low pressure may be provided between the inside of the impeller cover and the outside of the hub of the second diffuser. As a result, the air inside the hub of the second diffuser, which has a relatively high pressure, may be quickly moved to the air flow path through the communicating portion and may contact the motor inside the hub to form an air current moved toward the communicating portion, thereby accelerating cooling of the motor. In addition, the motor may maintain a relatively low temperature during operation, so that adverse effects due to high temperature may be reduced.

The first diffuser may be configured to include a hub and a plurality of blades provided around the hub. Because the first diffuser does not have an outer wall at an outer end of the plurality of blades in a radial direction, a mold for forming the plurality of blades may enable an access of the first diffuser in the radial direction, thereby facilitating manufacturing of the first diffuser.

In general, when a temperature of the motor is high, electrical resistance of a stator coil may increase to reduce power. However, in some implementations, the motor maintains a relatively low temperature during operation, and thus the increase in the electrical resistance of the stator coil may be restricted and power (e.g., output) may be enhanced.

The second diffuser may have a bearing accommodating portion in which a bearing supporting the rotating shaft of the motor is accommodated. Therefore, cooling of the bearing may be promoted.

In addition, the second diffuser may be made of a material having a thermal conductivity superior to the first diffuser. Accordingly, heat dissipation of the second diffuser may be promoted, and cooling of the bearing may be further promoted.

In order to achieve these and other advantages and in accordance with the purpose of this specification, as embodied and broadly described herein, there is provided a motor assembly including an impeller, a first diffuser disposed at a downstream side of the impeller, a second diffuser provided at a downstream side of the first diffuser, an impeller cover coupled to the second diffuser so that the impeller and the first diffuser are accommodated therein, and a motor provided at the downstream side of the second diffuser to drive the impeller. The second diffuser includes a hub, an outer wall concentrically disposed outside the hub, and a plurality of blades having one side connected to the hub and the other side connected to the outer wall. The impeller cover is coupled to the outer wall of the second diffuser. A communicating portion, which is configured to allow fluid communication between the inside and the outside of the hub of the second diffuser, is provided at the hub of the second diffuser.

Accordingly, air between the second diffuser and the motor may be discharged to the outside of the second diffuser through the communicating portion.

According to this configuration, the air heated by the motor during operation may be discharged to the outside of the second diffuser through the communicating portion, so that cooling of the motor may be promoted.

Because the impeller cover is coupled to the outer wall of the second diffuser, an air flow path with a relatively low pressure may be provided outside the hub of the second diffuser. Therefore, the air inside the hub of the second diffuser with relatively high pressure may be rapidly moved to the air flow path through the communicating portion, thereby promoting cooling of the motor.

In addition, the motor may maintain a relatively low temperature during operation, so that adverse effects due to high temperature may be reduced.

In general, when the temperature of the motor is high, electrical resistance of a stator coil may increase to thereby degrade power. However, in some implementations, the motor maintains a relatively low temperature during operation, and thus the increase in the electrical resistance of the stator coil may be restricted to improve power.

In addition, because the first diffuser and the second diffuser may be separately manufactured, the manufacturing of the diffusers may be facilitated. For example, in the first diffuser, a plurality of blades are provided around the hub and an outer wall is not provided outside the plurality of blades of the first diffuser. Therefore, the manufacturing of the first diffuser may be facilitated.

In an implementation of the present disclosure, the first diffuser includes a tubular hub having one side open along the axial direction and a plurality of blades provided at an outer wall of the hub. The hub of the second diffuser is inserted and coupled to the inside of the first diffuser so as to be in surface contact with the hub of the first diffuser. Accordingly, a coupling force between the first diffuser and the second diffuser may be improved.

According to the configuration, when an external force is applied to the first diffuser and the second diffuser, deformation of the first diffuser and the second diffuser may be restricted.

In an implementation of the present disclosure, the impeller includes a hub and a plurality of blades protruding radially around the hub and spaced apart from each other in a circumferential direction. The impeller may have a conical shape. The impeller may be configured to gradually increase in an outer diameter from an upstream end toward a downstream end.

In an implementation of the present disclosure, the hub of the second diffuser includes a bearing accommodating portion.

As a result, a bearing strength may be improved by the hub of the first diffuser that is coupled to the bearing accommodating portion to be in surface contact with each other. Therefore, the occurrence of deformation may be restricted.

In an implementation of the present disclosure, the second diffuser is made of a material having thermal conductivity superior to the first diffuser. Therefore, cooling of the bearing accommodating portion and the bearing may be promoted.

In an implementation of the present disclosure, the first diffuser may be made of a synthetic resin member, and the second diffuser may be made of a metal member. For example, the second diffuser may be formed of an aluminum member. Therefore, cooling of the bearing accommodating portion and the bearing may be further promoted.

In an implementation of the present disclosure, the second diffuser includes a heat dissipation fin protruding to increase a surface area. Therefore, cooling of the bearing may be further promoted.

In an implementation of the present disclosure, the heat dissipation fin includes a radial heat dissipation fin having one end connected to the circumference of the bearing accommodating portion and the other end disposed in a radial direction. Therefore, heat dissipation of thermal energy of the bearing accommodating portion may be promoted through the radial heat dissipation fin.

In addition, one end of the bearing accommodating portion may be supported by the radial heat dissipation fin connected to the circumference of the bearing accommodating portion, so that the bearing strength of the bearing accommodating portion may be improved.

According to this configuration, the occurrence of vibration and displacement of the bearing provided inside the bearing accommodating portion may be restricted. Therefore, the occurrence of wear of the bearing may be restricted.

In an implementation of the present disclosure, the heat dissipation fin include a circumferential heat dissipation fin disposed along a circumferential direction on an inner surface of the hub of the second diffuser. Accordingly, rigidity of the hub of the second diffuser may be improved.

According to this configuration, the occurrence of vibration and displacement of the bearing provided in the bearing accommodating portion may be restricted, so that the occurrence of wear of the bearing may be restricted.

In addition, heat dissipation of the thermal energy of the bearing accommodating portion may be promoted, so that cooling of the bearing provided in the bearing accommodating portion may be promoted.

In an implementation of the present disclosure, the motor includes a stator and a rotor rotatably disposed inside the stator, and the hub of the second diffuser includes a stator coupling portion coupled to the stator. Accordingly, a coupling force between the stator and the second diffuser may be stably provided.

In an implementation of the present disclosure, the stator coupling portion is provided in plurality and the plurality of stator coupling portions are spaced apart from each other along the circumferential direction of the stator. Accordingly, the coupling force between the stator and the second diffuser may be increased.

For example, the stator coupling portion may include an outer circumferential surface contact portion in surface contact with the outer circumferential surface of the stator. Accordingly, the coupling state of the stator and the second diffuser may be more stably maintained.

In an implementation of the present disclosure, the stator coupling portion may include an end surface contact portion in surface contact with one end of the stator along the axial direction. Accordingly, the occurrence of axial gap between the stator and the second diffuser may be restricted.

In an implementation of the present disclosure, the stator coupling portion includes a radial section having one end connected to the bearing accommodating portion and the other end extending in a radial direction. Therefore, rigidity of the bearing accommodating portion may be further improved.

In an implementation of the present disclosure, the stator coupling portion has an axial section extending in the axial direction from the radial section, and the outer circumferential surface contact portion is provided on an inner surface of the axial section. Accordingly, the coupling force between the second diffuser and the stator may be further improved.

In an implementation of the present disclosure, the end surface contact portion is provided in the axial section to further protrude inward along the radial direction compared to the outer circumferential surface contact portion. Accordingly, the bearing accommodating portion of the second diffuser is spaced apart from the end of the stator by a preset distance.

According to this configuration, a temperature rise of the bearing accommodating portion and the bearing due to heat generation of the stator coil may be restricted.

In an implementation of the present disclosure, the second diffuser is configured to include the stator coupling portion and the heat dissipation fin. Accordingly, the rigidity of the second diffuser may be improved, and the heat dissipation area may be increased.

In some implementations, the stator coupling portion is configured to have a relatively large size compared to the heat dissipation fin. For example, a width of the stator coupling portion along the circumferential direction is significantly larger than a width of the heat dissipation fin along the circumferential direction.

In addition, the height (or width) of the stator coupling portion along the axial direction is the same as the height (or width) of the heat dissipation fin along the axial direction. Alternatively, the height (or width) of the stator coupling portion along the axial direction is larger than the height (or width) of the heat dissipation fin along the axial direction.

The stator coupling portion may be implemented as three stator coupling portions, and the radial heat dissipation fin may be respectively provided between the radial sections of the stator coupling portions adjacent to each other along the circumferential direction.

The circumferential heat dissipation fin may be respectively provided between radial sections of the stator coupling portions adjacent to each other along the circumferential direction.

The radial heat dissipation fin may be connected by the circumferential heat dissipation fin.

With this configuration, the rigidity of the second diffuser may be remarkably improved. In addition, the heat dissipation area of the second diffuser may be remarkably increased.

In an implementation of the present disclosure, the first diffuser and the second diffuser have fastening member insertion holes penetrated along the axial direction so that a fastening member may be inserted, respectively. For example, a fastening member is coupled to the hub of the first diffuser and the hub of the second diffuser that are coupled to be in surface contact with each other, so that the hub of the first diffuser and the hub of the second diffuser are integrally coupled. Accordingly, the coupling force between the first diffuser and the second diffuser may be further improved.

In an implementation of the present disclosure, two blades adjacent to each other in the circumferential direction, among the plurality of blades of the second diffuser, are disposed such that an upstream end and a downstream end are spaced apart from each other in the circumferential direction.

For example, upstream ends of the plurality of blades of the first diffuser are arranged to be spaced apart from each other at a predetermined distance along the circumferential direction of the first diffuser, and the downstream ends of the plurality of blades extend along the circumferential direction of the first diffuser to be inclined with respect to the axial direction.

Therefore, each downstream end of the plurality of blades is arranged to overlap the upstream end of the other adjacent blade by a preset length. Further, a flow rate of the air moved by the impeller may be reduced and a static pressure may be increased.

In an implementation of the present disclosure, the plurality of blades of the second diffuser have an upstream end and a downstream end adjacent to each other, among the two blades adjacent to each other in the circumferential direction, to be spaced apart from each other in the circumferential direction.

For example, the upstream ends of the plurality of blades of the second diffuser are spaced apart from each other at preset intervals along the circumferential direction of the second diffuser, and each downstream end of the plurality of blades extends along the circumferential direction to be inclined with respect to the axial direction.

For example, the axial length of the second diffuser is shorter than the axial length of the first diffuser, and the downstream ends of two adjacent blades among the plurality of blades of the second diffuser and upstream ends of the other adjacent blades are spaced apart from each other along the circumferential direction.

According to this configuration, because the plurality of blades of the second diffuser do not overlap, manufacturing may be facilitated.

In an implementation of the present disclosure, the length of the blade of the second diffuser is shorter than the length of the blade of the first diffuser.

In an implementation of the present disclosure, the impeller cover includes an impeller accommodating portion in which the impeller is accommodated, a suction portion extending in the axial direction from an upstream end of the impeller accommodating portion and suctioning air, and a first diffuser accommodating portion extending in the axial direction from a downstream end of the impeller accommodating portion and accommodating the first diffuser. As a result, an air flow path communicating with each other is provided between the inside of the impeller cover and the impeller and between the impeller cover and the first diffuser.

In some implementations, the impeller accommodating portion has a conical shape to correspond to a shape of the impeller, and the suction portion and the first diffuser accommodating portion have a cylindrical shape.

In an implementation of the present disclosure, an outer end of the blade of the first diffuser along the radial direction is disposed to face an inner circumferential surface of the first diffuser accommodating portion.

In an implementation of the present disclosure, the outer end of the blade of the first diffuser along the radial direction is disposed to be in contact with the inner circumferential surface of the first diffuser accommodating portion.

Accordingly, it is possible to restrict the occurrence of a flow loss of air moved between the plurality of blades of the first diffuser and the impeller cover by the impeller.

In an implementation of the present disclosure, the hub of the first diffuser includes a through portion penetrating along the axial direction, and the hub of the second diffuser includes a protrusion that protrudes along the axial direction and is inserted into the through portion. Accordingly, the hub of the first diffuser and the hub of the second diffuser overlap in the axial direction, thereby reducing an axial length of the diffuser.

In an implementation of the present disclosure, an anti-rotation protrusion protruding in the axial direction is provided at one of the mutual contact surfaces of the hub of the first diffuser and the hub of the second diffuser, and an anti-rotation protrusion accommodating recess accommodating the anti-rotation protrusion is provided at the other of the mutual contact surfaces. Accordingly, the first diffuser and the second diffuser may be assembled at an accurate position. In addition, the occurrence of a gap of the first diffuser and the second diffuser in the circumferential direction may be restricted.

In an implementation of the present disclosure, a bearing accommodating portion in which a bearing is accommodated is provided at a rear surface of the protrusion of the second diffuser.

In an implementation of the present disclosure, the communicating portion is provided between the blade of the first diffuser and the blade of the second diffuser along the axial direction.

For example, the hub of the second diffuser is configured to protrude from the hub of the first diffuser along the axial direction, and the plurality of blades of the first diffuser and the plurality of blades of the second diffuser are spaced apart from each other by a preset length along the axial direction.

Further, the communicating portion may be provided through a lower side of the downstream end of the hub of the first diffuser.

The communicating portion may be provided at the downstream side of the plurality of blades of the first diffuser.

The communicating portion may be provided at the upstream side of the plurality of blades of the second diffuser.

Therefore, lowering of suction power (or suction efficiency) of the impeller due to the formation of the communicating portion may be restricted.

In an implementation of the present disclosure, the communicating portion is implemented in plurality, which are spaced apart from each other along the circumferential direction of the diffuser. For example, the communicating portion is implemented as 2 to 15 pieces.

In an implementation of the present disclosure, the hub of the second diffuser includes a cylindrical portion and a disk portion disposed to block one end of the cylindrical portion. The disk portion may be provided at an upstream end of the cylindrical portion based on a moving direction of the air moved by the impeller.

In an implementation of the present disclosure, the communicating portion includes (i) a radial section having one side opened to the inside of the disk portion of the second diffuser and the other side extending to the outside of the cylindrical portion along the radial direction of the disk portion and (ii) an axial section having one side communicating with the radial section and the other side extending along the axial direction. Therefore, the extraction of air from the center of the upstream end of the motor may be facilitated.

For example, the axial section of the communicating portion may be configured to include a first axial section communicating with the radial section and recessed in the outer surface of the second diffuser.

The axial section of the communicating portion may be configured to include a second axial section communicating with the radial section and recessed in the inner surface of the hub of the first diffuser.

In an implementation of the present disclosure, the axial section may be configured to include (i) a first axial section recessed in the outer surface of the second diffuser and being in fluid communication with the first axial section and (ii) a second axial section being in fluid communication with the radial section and recessed in the inner surface of the hub of the diffuser.

Further, the first axial section and the second axial section may be configured to form a flow path through which air is moved cooperatively.

Accordingly, an increase in the thickness of the hub of the first diffuser and/or the hub of the second diffuser due to the formation of the axial section may be restricted.

In an implementation of the present disclosure, the second diffuser includes a bracket coupling portion to which a bracket is coupled.

Further, the bracket is configured to include (i) a bearing accommodating portion in which a bearing is accommodated and (ii) a plurality of leg portions having one end connected to the bearing accommodating portion and the other end curved and disposed along the axial direction.

A bearing, which is disposed at the downstream side of the rotor based on the moving direction of the air moved by the impeller, may be accommodated in the bearing accommodating portion of the bracket.

The plurality of leg portions of the bracket may be configured to be in contact with the ends of the stator coupling portions of the second diffuser, respectively.

The plurality of leg portions may be integrally coupled to the stator coupling portion by a fastening member.

The stator coupling portion may include a fastening member coupling portion to which the fastening member is screwed.

A fastening member insertion portion for allowing the fastening member to be inserted therein may be disposed to penetrate along the axial direction in the plurality of leg portions.

As described above, according to an implementation of the present disclosure, the impeller, the first diffuser, the second diffuser, the impeller cover, and the motor are coupled along the axial direction. The second diffuser includes a hub, an outer wall, and a plurality of blades having one side connected to the circumference of the hub and the other side connected to the outer wall. The impeller cover is coupled to the outer wall of the second diffuser, and the communicating portion for allowing fluid communication between the inside and the outside of the hub is provided at the hub of the second diffuser. Therefore, the air inside the second diffuser may be discharged to the outside, while restricting a decrease in the suction efficiency of the impeller. As a result, cooling of the motor may be promoted.

In addition, because the first diffuser is accommodated inside the impeller cover and is configured to include the hub and the plurality of blades provided around the hub, the use of an outer wall may be eliminated, so that the first diffuser may be easily manufactured.

In addition, because the bearing accommodating portion is provided at the hub of the second diffuser, vibration and/or displacement of the bearing may be restricted.

In addition, because the second diffuser includes a member having thermal conductivity superior to the first diffuser, cooling of the bearing may be promoted.

In addition, because the second diffuser includes the heat dissipation fin, the cooling of the bearing provided at the bearing accommodating portion may be further promoted.

In addition, by providing the radial heat dissipation fin radially connected to the circumference of the bearing accommodating portion of the second diffuser, the occurrence of vibration of the bearing accommodating portion may be restricted and cooling of the bearing provided in the bearing accommodating portion may be promoted.

In addition, because the circumferential heat dissipation fin disposed in the circumferential direction are provided at the hub of the second diffuser, cooling of the bearing may be further promoted.

In addition, because the hub of the second diffuser includes the stator coupling portion coupled to the stator, the second diffuser and the stator may be concentrically coupled to each other.

In addition, the stator coupling portion is provided in plurality and includes an outer circumferential surface contact portion that is in surface contact with the outer circumferential surface of the stator on the inner surface. As such, the coupling force between the second diffuser and the stator may be further improved.

In addition, because the stator coupling portion includes the end surface contact portion that is in surface contact with the end of the stator along the axial direction, the occurrence of a relative gap along the axial direction may be restricted.

In addition, because the end surface contact portion is disposed to protrude from the outer circumferential surface contact portion along the radial direction, the hub of the second diffuser and the end of the stator may be spaced apart from each other in the axial direction. Accordingly, the bearing accommodating portion of the second diffuser and the stator are spaced apart from each other along the axial direction to restrict a temperature rise.

In addition, the first diffuser and the second diffuser may be coupled by a fastening member, so that coupling force may be improved.

In addition, as for the plurality of blades of the second diffuser, the upstream end and the downstream end of the two blades adjacent to each other in the circumferential direction are configured to be spaced apart from each other along the circumferential direction, thereby facilitating the manufacturing process.

In addition, because the communicating portion is disposed between the blade of the first diffuser and the blade of the second diffuser along the axial direction, a degradation of the suction efficiency of the impeller due to the formation of the communicating portion may be restricted.

In addition, because the communicating portion includes the radial section disposed in the radial direction at the disk portion of the hub of the second diffuser and the axial section disposed at the hub along the axial direction, the air in the central region of the motor (e.g., stator) may be easily discharged.

In addition, because the axial section includes the first axial section recessed at the outer surface of the hub of the second diffuser and the second axial section disposed at the inner surface of the hub of the first diffuser, an increase in thickness of the hub of the first diffuser and the hub of the second diffuser due to the formation of the axial section may be restricted.

DETAILED DESCRIPTION

Hereinafter, implementations of the present disclosure will be described in detail with reference to the accompanying drawings. For the sake of brief description with reference to the drawings, the same or equivalent components will be provided with the same reference numbers, and description thereof will not be repeated. A singular representation used herein may include a plural representation unless it represents a definitely different meaning from the context. In describing the present disclosure, if a detailed explanation for a related known function or construction is considered to unnecessarily divert the gist of the present disclosure, such explanation has been omitted but would be understood by those skilled in the art. The accompanying drawings are used to help easily understand the technical idea of the present disclosure and it should be understood that the idea of the present disclosure is not limited by the accompanying drawings.

Figure 1:
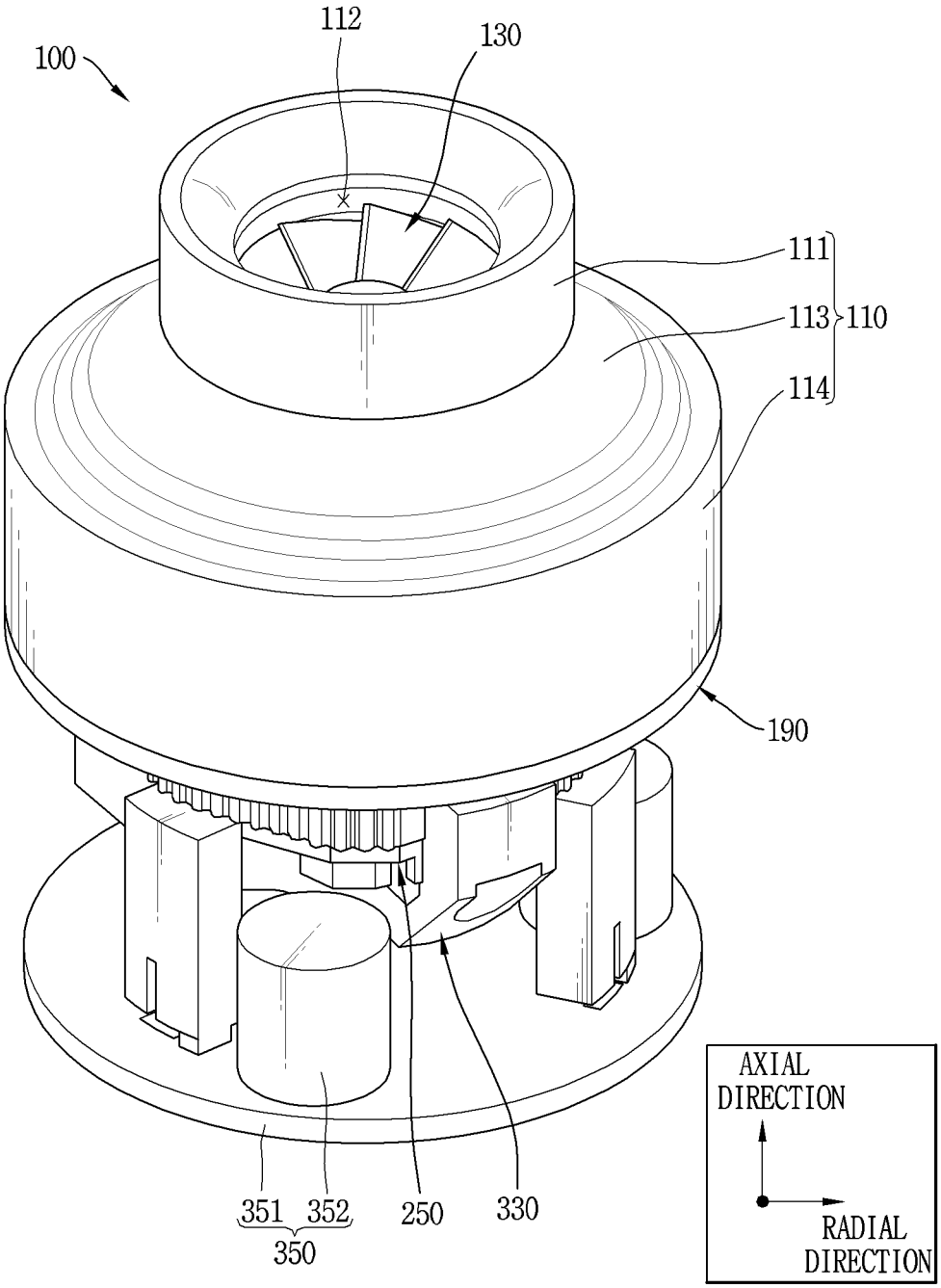
FIG. 1 is a perspective view of a motor assembly according to an implementation of the present disclosure.
Figure 2:
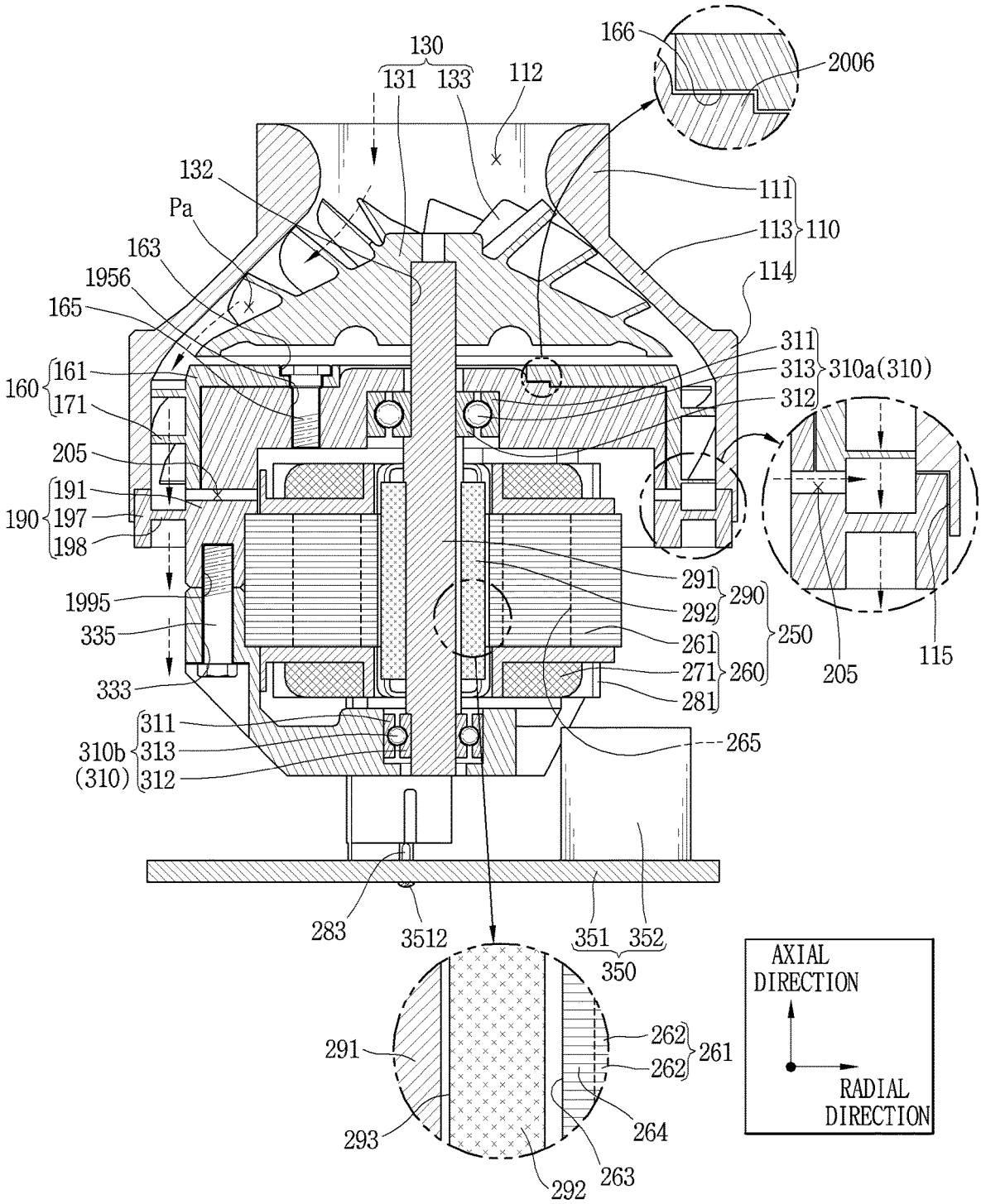
FIG. 2 is a cross-sectional view of the motor assembly of FIG. 1.
Figure 3:
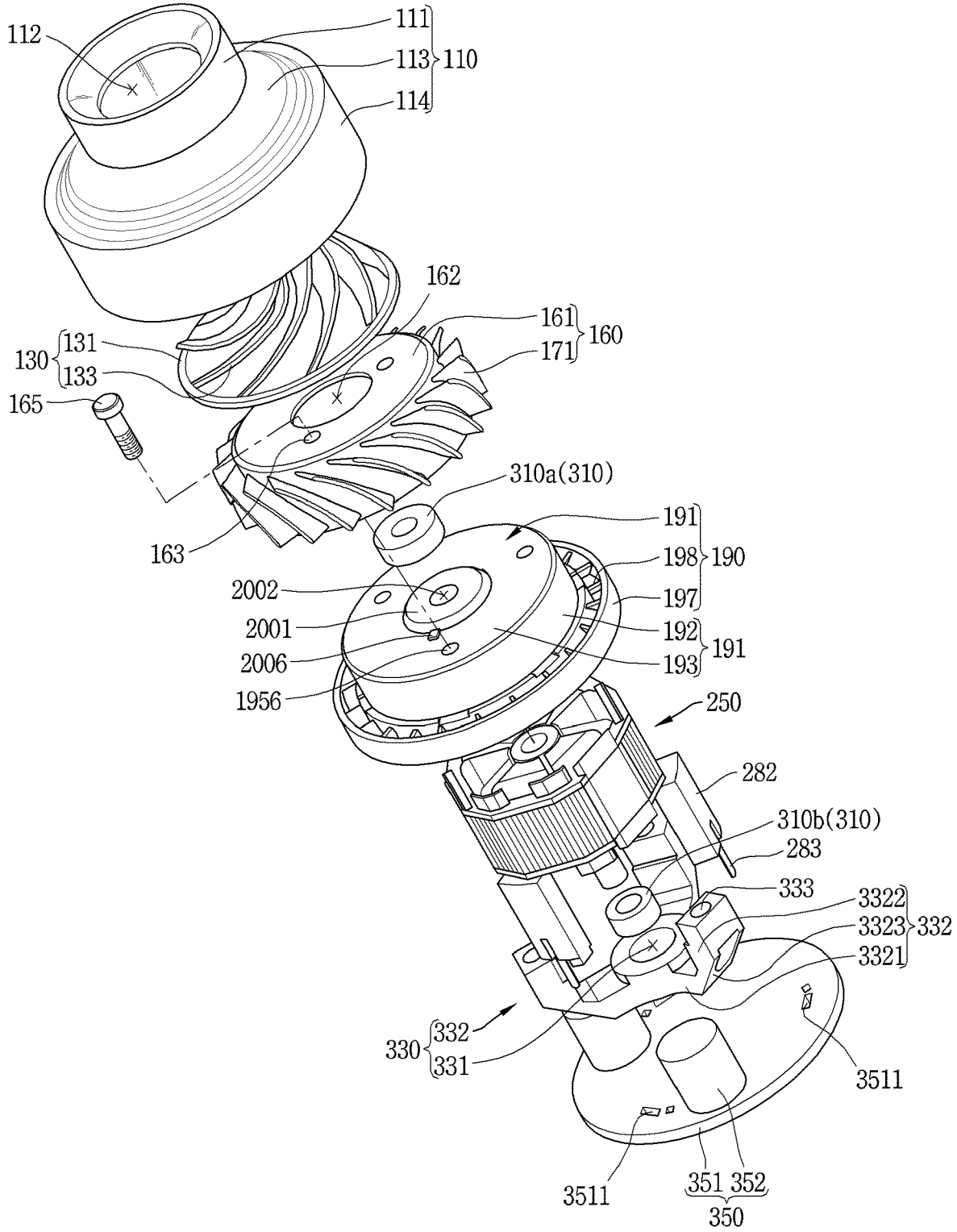
FIG. 3 is an exploded perspective view of the motor assembly of FIG. 1.

FIG. 1 is a perspective view of a motor assembly according to an implementation of the present disclosure, FIG. 2 is a cross-sectional view of the motor assembly of FIG. 1, and FIG. 3 is an exploded perspective view of the motor assembly of FIG. 1. As shown in FIGS. 1 to 3, a motor assembly 100 according to an implementation of the present disclosure includes an impeller cover 110, an impeller 130, a first diffuser 160, a second diffuser 190, and a motor 250.

The impeller cover 110, the impeller 130, the first diffuser 160, the second diffuser 190, and the motor 250 are coupled along an axial direction.

The axial direction may refer to a direction parallel to a rotating shaft 291 of the motor 250. In FIGS. 1 and 2, the axial direction coincides with a vertical direction.

For example, the first diffuser 160 is coupled to one side (e.g., a lower side in the drawing) of the impeller 130 along the axial direction, and the second diffuser 190 is coupled to one side (e.g., a lower side in the drawing) of the first diffuser 160.

Between the impeller cover 110, the first diffuser 160, and the second diffuser 190, an air flow path Pa through which air introduced by the rotation of the impeller 130 moves is provided.

The motor 250 is coupled to one side (e.g., a lower side in the drawing) of the second diffuser 190 along the axial direction.

The impeller 130 and the first diffuser 160 are accommodated inside the impeller cover 110.

The impeller cover 110 is coupled to the second diffuser 190.

When the impeller 130 rotates, air is sucked into the impeller cover 110 and moves via the first diffuser 160 and the second diffuser 190. The air passing through the second diffuser 190 is moved along the axial direction radially outward of the motor 250.

In some implementations, the impeller 130 includes a hub 131 and a plurality of blades 133 disposed in a circumferential direction around the hub 131.

The impeller 130 may be configured to rotate in a counterclockwise direction, for example, in the view of FIG. 1.

The hub 131 of the impeller 130 has, for example, a conical cross-section.

A rotating shaft hole 132 is provided in the center of the hub 131 of the impeller 130 so that a rotating shaft 291 of the motor 250 may be inserted.

The impeller cover 110 is coupled to the outside of the impeller 130.

The impeller 130 is rotatably accommodated inside the impeller cover 110.

When the impeller 130 rotates, air is sucked in from the front (e.g., an upper side in the drawing) of the impeller cover 110 and discharged to the rear (e.g., a lower side in the drawing).

The front (e.g., an upper side in the drawing) of the impeller cover 110 through which air is sucked based on the moving direction of the air moved during rotation of the impeller 130 is referred to as an 'upstream side', and the rear (e.g., a lower side) of the impeller cover 110 from which the air is discharged may be referred to as a 'downstream side'.

A suction port 112 through which air is sucked is provided in the center of the impeller cover 110.

The impeller cover 110 includes an impeller accommodating portion 113 accommodating the impeller 130 and a first diffuser accommodating portion 114 accommodating the first diffuser 160.

The impeller accommodating portion 113 is implemented in a conical shape to correspond to the shape of the impeller 130.

The impeller cover 110 has a suction portion 111 through which air is sucked.

The suction portion 111 may be disposed to extend along the axial direction from the upstream end of the impeller accommodating portion 113.

The suction port 112 is disposed inside the suction portion 111 to penetrate along the axial direction.

An inner surface of the suction portion 111 may be implemented, for example, in a circular arc cross-sectional shape in which the center is convex inward.

The first diffuser accommodating portion 114 extends along the axial direction from the downstream end of the impeller accommodating portion 113.

The suction portion 111 is implemented in a cylindrical shape having the same outer diameter though a length of the suction portion 111.

The impeller accommodating portion 113 is implemented in a conical cross-sectional shape in which the outer diameter is gradually enlarged.

The first diffuser accommodating portion 114 is implemented in a cylindrical shape having the same outer diameter though a length of the first diffuser accommodating portion 114.

The impeller cover 110 is coupled to the second diffuser 190.

For example, the downstream end of the impeller cover 110 is coupled to the upstream end of the second diffuser 190.

An insertion portion 115 is provided at the downstream end of the impeller cover 110 so that the upstream end of the second diffuser 190 may be inserted.

The insertion portion 115 is cut to extend along the radial direction on the inner surface of the impeller cover 110.

The upstream end of the second diffuser 190 is in contact with the insertion portion 115 along the axial direction.

Accordingly, an axial movement of the impeller cover 110 and the second diffuser 190 may be restricted.

An outer circumference of the insertion portion 115 is disposed radially outside the outer wall 197 of the second diffuser 190, which will be described later.

The first diffuser 160 is disposed on one side (e.g., a lower side or a downstream side in the drawing) of the impeller 130 along the axial direction.

The first diffuser 160 is disposed to be spaced apart by a preset width along the axial direction so that the impeller 130 may be rotated.

The second diffuser 190 is coupled to one side (e.g., a lower side in the drawing) of the first diffuser 160.

The first diffuser 160 includes a hub 161 and a plurality of blades 171 arranged in a circumferential direction around the hub 161.

The first diffuser 160 is installed inside the impeller cover 110 so that the outer ends of the plurality of blades 171 face the inner circumferential surface of the first diffuser accommodating portion 114.

In some implementations, the outer ends of the plurality of blades 171 of the first diffuser 160 are configured to contact the inner circumferential surface of the first diffuser accommodating portion 114.

Accordingly, the occurrence of flow loss of the air sucked into the impeller cover 110 by the rotation of the impeller 130 may be restricted.

The second diffuser 190 includes a hub 191, an outer wall 197 concentrically disposed around the hub 191, a plurality of blades 198 having one end connected to the hub 191 and the other end connected to the outer wall 197.

The outer wall 197 is provided outside the downstream end of the hub 191 of the second diffuser 190.

For example, the outer wall 197 is concentrically disposed to be spaced apart from the outer circumference of the downstream end of the hub 191 of the second diffuser 190 by a predetermined distance.

A region (e.g., an upper region in the drawing) of the second diffuser 190 is inserted into and coupled to the inside of the first diffuser 160. Another region (e.g., a lower region in the drawing) of the second diffuser 190 protrudes to the outside of the first diffuser 160.

For example, the hub 191 of the second diffuser 190 is inserted and coupled to the inside of the hub 161 of the first diffuser 160.

The outer wall 197 of the second diffuser 190 is exposed to the outside of the first diffuser 160.

The impeller cover 110 is coupled to the outer wall 197 of the second diffuser 190.

The upstream end of the outer wall 197 of the second diffuser 190 is in contact with the end of the insertion portion 115 of the impeller cover 110 along the axial direction.

A region (e.g., an upper region in the drawing) of the motor 250 is inserted and coupled to the inside of the second diffuser 190 along the axial direction.

The motor 250 includes a stator 260 and a rotor 290 rotatable with respect to the stator 260.

The stator 260 includes, for example, a stator core 261 and a stator coil 271 wound around the stator core 261.

A rotor accommodating hole 263 in which the rotor 290 is rotatably accommodated with a predetermined air gap (G) is disposed in the stator core 261.

The rotor accommodating hole 263 is disposed to penetrate along the axial direction.

A plurality of teeth 264 and slots 265 are alternately disposed around the rotor accommodating hole 263 along the circumferential direction.

The stator core 261 is disposed by insulating and stacking a plurality of electrical steel sheets 262 each having the rotor accommodating hole 263, a plurality of slots 265, and teeth 264.

An insulator 281 for insulating the stator coil 271 is provided in the stator core 261. The insulator 281 may be configured to be coupled to contact each other on both sides of the stator core 261 along the axial direction, for example.

The rotor 290 includes, for example, a rotating shaft 291 and a permanent magnet 292 that is configured to rotate about the rotating shaft 291.

The permanent magnet 292 is implemented in a cylindrical shape.

A rotating shaft hole 293 is disposed through the center of the permanent magnet 292 so that the rotating shaft 291 may be inserted.

The rotating shaft 291 is rotatably supported by a bearing 310.

The bearing 310 may be disposed on both sides of the permanent magnet 292 along the axial direction.

The bearing 310 may be implemented as, for example, a ball bearing.

For example, the bearing 310 includes an outer ring, an inner ring concentrically disposed inside the outer ring, and a plurality of balls disposed between the outer ring and the inner ring.

The bearing 310 includes, for example, a first bearing 310*a* provided between the impeller 130 and the rotor 290 and a second bearing 310*b* spaced apart from the first bearing 310*a* along the axial direction.

In some implementations, the first bearing 310*a* has a larger size than the second bearing 310*b*. For example, the outer ring 311, the inner ring 312, and the ball 313 of the first bearing 310*a* are larger than the outer ring 311, the inner ring 312 and the ball 313 of the second bearing 310*b*, respectively. Accordingly, the impeller 130 and the rotor 290 may be stably supported.

A bracket 330 is coupled to one side (e.g., a lower side in the drawing) of the stator 260.

The bracket 330 includes, for example, a bearing accommodating portion 331 in which the bearing 310 is accommodated and a plurality of leg portions 332 having one end connected to the bearing accommodating portion 331 and the other end bent to be disposed in the axial direction.

In some implementations, the second bearing 310*b* is accommodated and coupled to the bearing accommodating portion 331 of the bracket 330.

The plurality of leg portions 332 is implemented, for example, in three pieces.

The plurality of leg portions 332 include, for example, a radial section 3321 extending along a radial direction from the bearing accommodating portion 331 and an axial section 3322 bent from the radial section 3321 and extending in the axial direction.

In an outer boundary region of the radial section 3321 and the axial section 3322, an inclined portion 3323 cut obliquely with respect to the axial direction is provided.

A fastening member insertion portion 333 is disposed through the axial section 3322 so that the fastening member 335 coupled to the second diffuser 190 may be inserted. Here, the fastening member 335 may be configured to be screwed to the second diffuser 190.

The stator coil 271 can be connected to a printed circuit board (PCB) 350.

The stator coil 271 may be connected to, for example, a three-phase AC power source.

The stator coil 271 may include a plurality of phase coils connected to phase power (U-phase, V-phase, and W-phase) of the AC power.

In some implementations, the motor assembly 100 may be implemented, for example, as a relatively small motor assembly in which an outer diameter of the impeller cover 110 is about 55 mm, an outer diameter of the stator 260 is about 40 mm, and an outer diameter of the rotor 290 is about 9 mm. Therefore, the size and weight of the motor assembly 100 may be reduced.

Further, in some implementations, when the motor assembly 100 is installed in a handheld device, installation and handling may be facilitated.

In some implementations, the stator 260 and the rotor 290 are implemented so that high-speed rotation (e.g., 100 krpm to 180 krpm) is possible.

As a result, even though the size and weight of the motor assembly 100 are reduced, a relatively high-speed rotation is secured, so that an air volume can be maintained or secured to the level that is equal to or greater than that of a motor assembly having no reduction in size and weight.

A plurality of connection terminals 283 respectively connected to the plurality of phase coils are provided on one side of the stator 260. The stator 260 includes a plurality of connection terminal support portions 282 supporting the plurality of connection terminals 283. The connection terminal support portion 282 may be provided in the insulator 281, for example. The plurality of connection terminal support portions 282 are spaced apart from each other in the circumferential direction. The plurality of connection terminal support portions 282 are configured to extend to one side (e.g., a lower side in the drawing) along the axial direction. The plurality of connection terminal support portions 282 are provided such that the plurality of connection terminals 283 are respectively arranged on the downstream side of the bracket 330 in the axial direction. The plurality of connection terminals 283 may be respectively arranged between the plurality of leg portions 332 of the bracket 330, for example.

The PCB 350 is provided on one side (e.g., a lower side in the drawing) of the bracket 330 in the axial direction.

The PCB 350 includes, for example, a substrate 351 and a circuit component 352 mounted on the substrate 351. The substrate 351 may include, for example, an inverter circuit capable of providing three-phase AC power to the stator coil 271.

The substrate 351 may be implemented, for example, in a disk shape.

A plurality of connection terminal insertion portions 3511 to which the plurality of connection terminals 283 are respectively inserted and coupled are provided on the substrate 351. The plurality of connection terminal insertion portions 3511 are respectively disposed to penetrate through the substrate 351.

The plurality of connection terminal insertion portions 3511 include a joint portion 3512 for electrically connecting the plurality of connection terminals 283, respectively. The joint portion 3512 may be provided, for example, by soldering the connection terminal 283 and the connection terminal insertion portion 3511 to each other.

Figure 4:
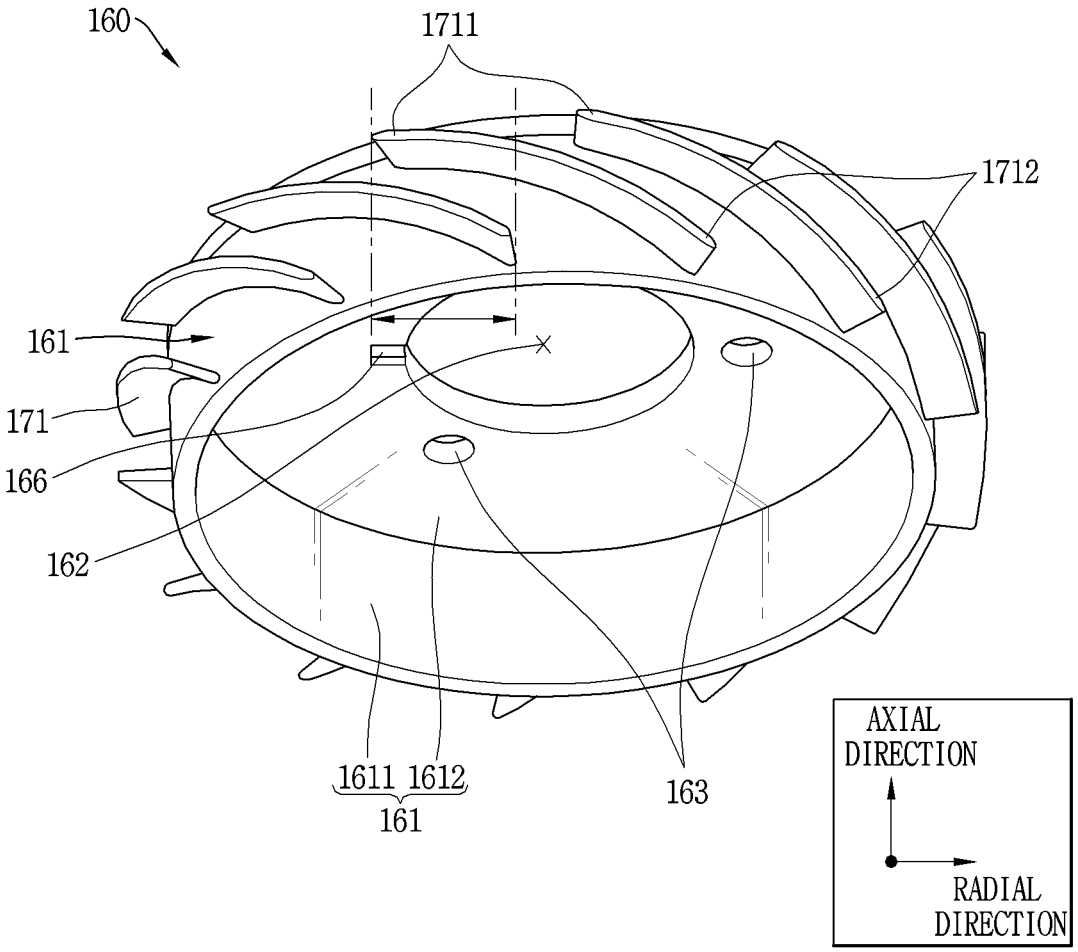
FIG. 4 is a perspective view of a first diffuser of FIG. 3.

FIG. 4 is a perspective view of the first diffuser of FIG. 3. As shown in FIG. 4, the first diffuser 160 includes the hub 161 and the plurality of blades 171.

The first diffuser 160 is formed of, for example, a synthetic resin member. Accordingly, a weight of the first diffuser 160 may be reduced.

The hub 161 of the first diffuser 160 has a downwardly opened cylindrical shape.

For example, the hub 161 of the first diffuser 160 may have an upstream end blocked and a downstream end open based on a moving direction of the air moved by the impeller 130.

The hub 161 of the first diffuser 160 includes a cylindrical portion 1611 and a disk portion 1612 disposed to block one end of the cylindrical portion 1611 along the axial direction.

In some implementations, the disk portion 1612 of the first diffuser 160 is disposed at an upstream end of the cylindrical portion 1611.

A through portion 162 is disposed in the center of the hub 161 (e.g., the disk portion 1612) of the first diffuser 160 so that a protrusion 2001 of the second diffuser 190, which will be described later, may be inserted.

The first diffuser 160 may be fastened to the second diffuser 190 by a fastening member 165.

Accordingly, the coupling force between the first diffuser 160 and the second diffuser 190 may be improved.

A fastening member insertion hole 163 is disposed through the hub 161 of the first diffuser 160 so that the fastening member 165 may be inserted.

The fastening member insertion hole 163 is provided as a plurality of fastening member insertion holes spaced apart from each other in the circumferential direction on the circumference of the through portion 162.

A plurality of blades 171 are provided on the outer surface of the hub 161 of the first diffuser 160. The plurality of blades 171 are arranged to be spaced apart from each other in the circumferential direction. The plurality of blades 171 are, for example, respectively arranged to be inclined with respect to the axial direction. For example, the plurality of blades 171 are each implemented in a curved cross-sectional shape in which the center is convex toward the upstream side.

The plurality of blades 171 are each configured such that a downstream end is disposed in front of an upstream end based on a rotation direction of the impeller 130.

The plurality of blades 171 of the first diffuser 160 is configured such that an upstream end 1711 and a downstream end 1712 of two adjacent blades 171 overlap each other in the axial direction.

The downstream end 1712 of the rear blade 171 based on the rotation direction of the impeller 130 is disposed at a lower front than the upstream end 1711 of the front blade 171. That is, the two blades adjacent to each other of the first diffuser 160 are disposed to overlap each other in the axial direction by about half the length of the blades.

Figure 5:
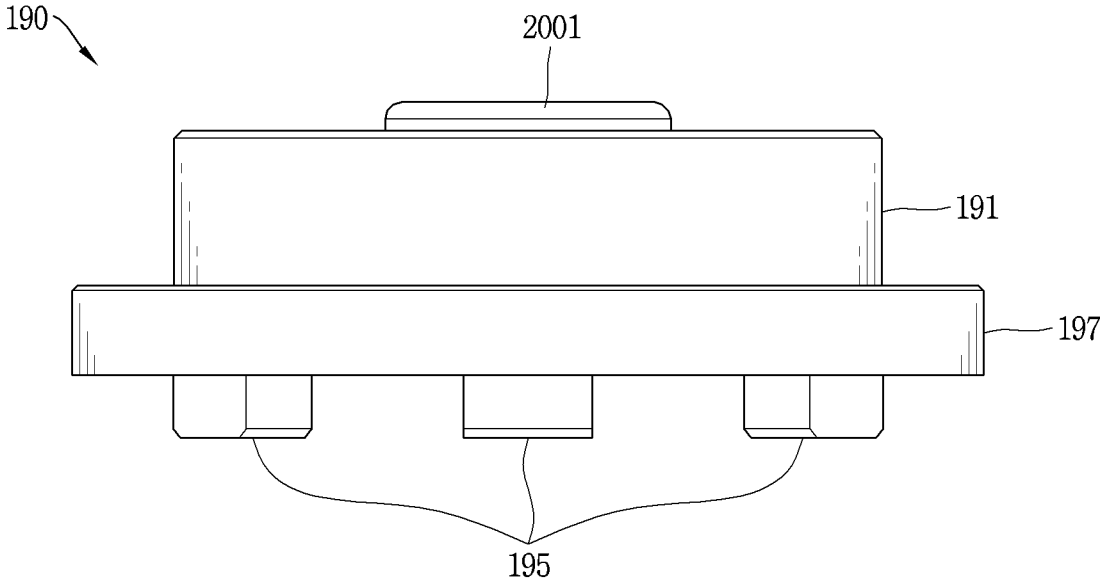
FIG. 5 is a side view of a second diffuser of FIG. 3.
Figure 6:
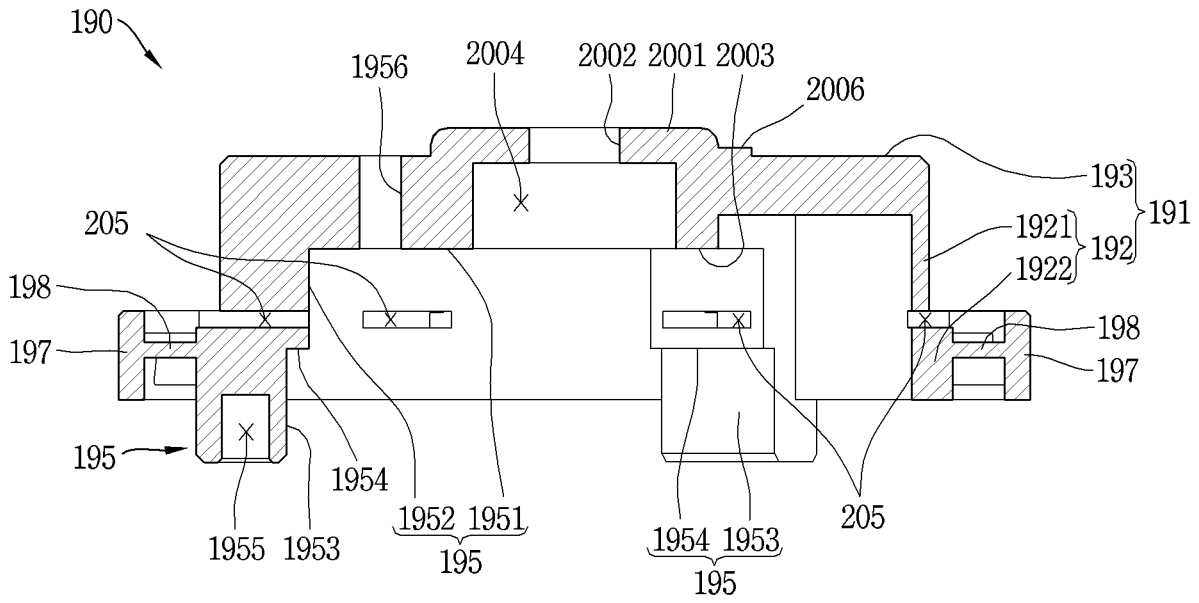
FIG. 6 is a cross-sectional view of the second diffuser of FIG. 5.
Figure 7:
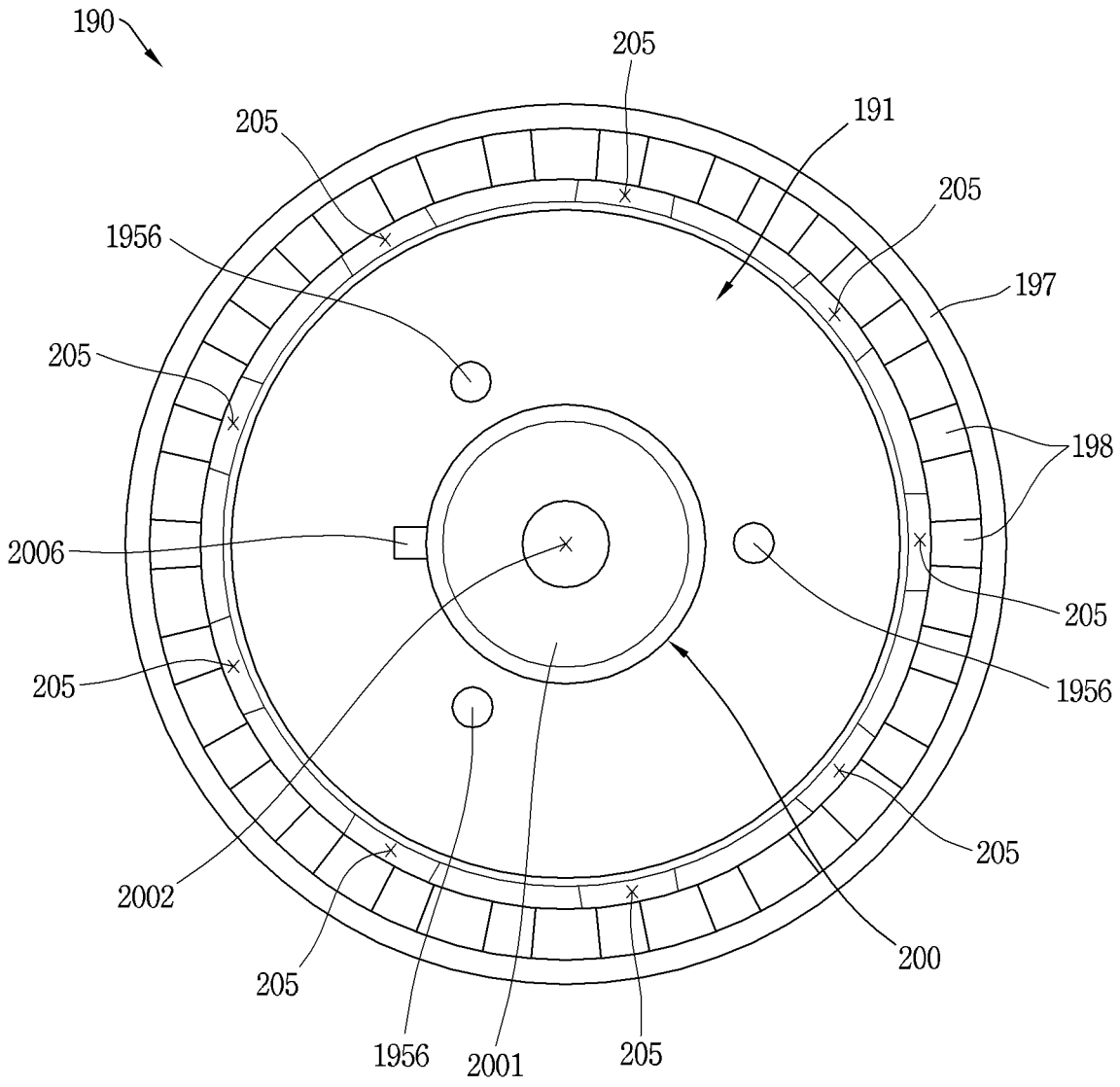
FIG. 7 is a bottom view of the second diffuser of FIG. 5.
Figure 8:
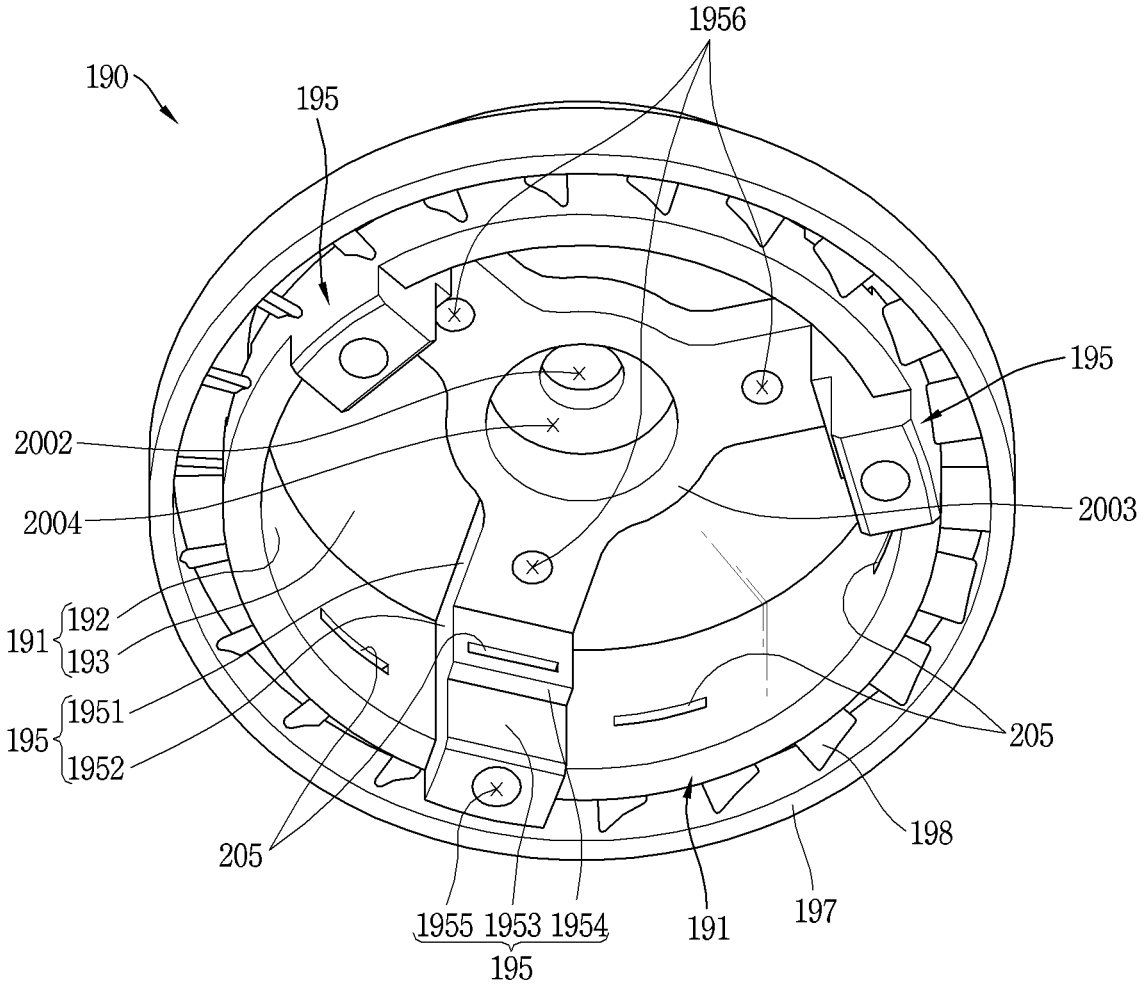
FIG. 8 is a bottom perspective view of the second diffuser of FIG. 5.
Figure 9:
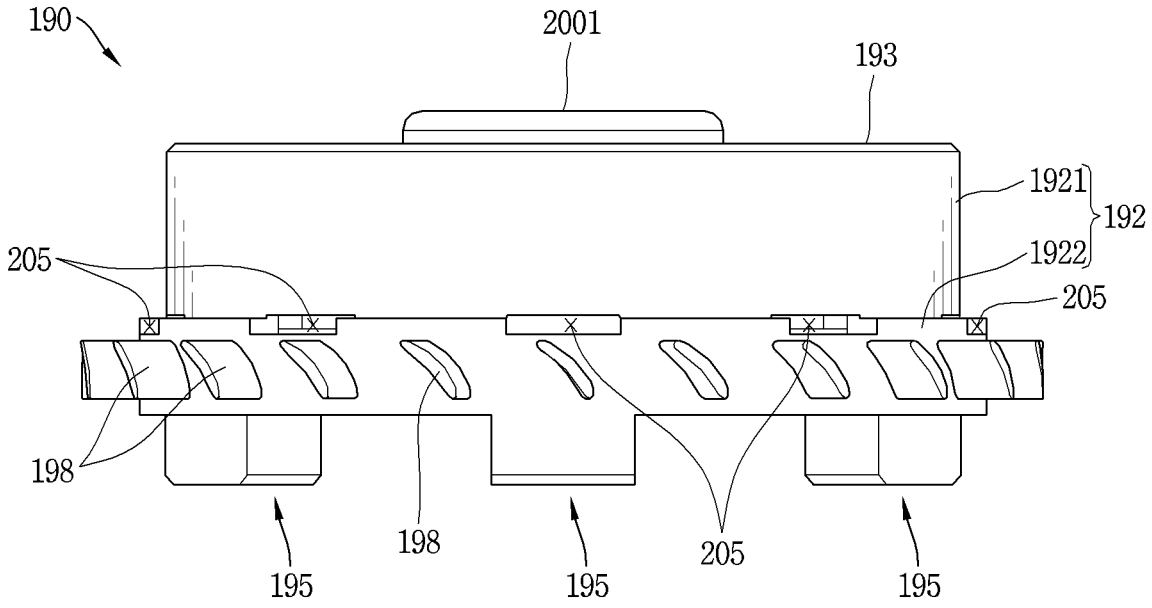
FIG. 9 is a view with an outer wall of the second diffuser of FIG. 5 being removed.

FIG. 5 is a side view of the second diffuser of FIG. 3, FIG. 6 is a cross-sectional view of the second diffuser of FIG. 5, FIG. 7 is a bottom view of the second diffuser of FIG. 5, FIG. 8 is a bottom perspective view of the second diffuser of FIG. 5, and FIG. 9 is a view in which an outer wall of the second diffuser of FIG. 5 is removed. As shown in FIGS. 5 to 9, the second diffuser 190 includes a hub 191, an outer wall 197, and a plurality of blades 198.

The hub 191 of the second diffuser 190 has a cylindrical shape with one side (e.g., a lower side in the drawing) opened. The hub 191 of the second diffuser 190 is implemented in a downwardly opened cylindrical shape. The hub 191 of the second diffuser 190 includes, for example, a cylindrical portion 192 and a disk portion 193 disposed to block one end of the cylindrical portion 192 along the axial direction.

The hub 191 of the second diffuser 190 is configured to be inserted into the hub 161 of the first diffuser 160.

The outer surface of the hub 191 of the second diffuser 190 is configured to be in surface contact with the inner surface of the hub 161 of the first diffuser 160.

For example, the cylindrical portion 192 of the hub 191 of the second diffuser 190 is coupled to be in surface contact with the inner surface of the cylindrical portion 1611 of the hub 161 of the first diffuser 160.

The disk portion 193 of the hub 191 of the second diffuser 190 is coupled to be in surface contact with the inner surface of the cylindrical portion 1611 of the hub 161 of the first diffuser 160.

The hub 191 of the second diffuser 190 is configured to protrude toward one side (e.g., a lower side in the drawing) along the axial direction when coupled with the first diffuser 160.

In some implementations, any one of the mutual contact surfaces (e.g., interfacing surfaces) of the second diffuser 190 and the first diffuser 160 includes an axially protruding anti-rotation protrusion 2006, and the other includes an anti-rotation protrusion accommodating recess 166 into which the anti-rotation protrusion is inserted.

The anti-rotation protrusion 2006 may be disposed, for example, on the second diffuser 190. The anti-rotation protrusion 2006 is provided on the radially outer side of the protrusion 2001. For example, the anti-rotation protrusion 2006 is disposed to protrude from the outer surface of the second diffuser 190.

The anti-rotation protrusion accommodating recess 166 may be disposed in the first diffuser 160. The anti-rotation protrusion accommodating recess 166 is, for example, disposed to be recessed along the axial direction on the inner surface of the first diffuser 160. The anti-rotation protrusion accommodating recess 166 is provided on the radially outer side of the through portion 162.

The hub 191 of the second diffuser 190 includes a first section 1921 inserted into the hub 161 of the first diffuser 160 and a second section 1922 disposed outside the first diffuser 160. Here, the second section 1922 is configured to further protrude outward from an outer circumference of the first section 1921 in the radial direction.

An outer diameter of the second section 1922 is larger than an outer diameter of the first section 1921.

The outer diameter of the second section 1922 may be, for example, the same size as the outer diameter of the hub 161 of the first diffuser 160.

When the first diffuser 160 and the second diffuser 190 are combined, a lower end of the first diffuser 160 may be in surface contact with an upper end of the second section 1922.

A bearing accommodating portion 2003 is provided at the center of the hub 191 of the second diffuser 190.

The bearing accommodating portion 2003 of the second diffuser 190 is disposed on a rear surface of the protrusion 2001.

The bearing accommodating portion 2003 of the second diffuser 190 is disposed to protrude along the axial direction at an inner center of the hub 191 of the second diffuser 190.

The bearing accommodating portion 2003 is disposed in the disk portion 193 of the hub 191 of the second diffuser 190.

An accommodating space 2004 in which the bearing 310 (e.g., the first bearing 310*a*) is accommodated is disposed in the bearing accommodating portion 2003.

The second diffuser 190 is formed of a member having superior thermal conductivity compared to the first diffuser 160. Therefore, cooling of the bearing 310 (e.g., the first bearing 310*a*) accommodated in the bearing accommodating portion 2003 may be promoted.

The second diffuser 190 is formed of a metal member. Accordingly, heat dissipation of the second diffuser 190 may be promoted. In addition, the rigidity of the second diffuser 190 may be improved. The second diffuser 190 is formed of, for example, an aluminum (Al) member.

A through hole 2002 through which the rotating shaft 291 may pass is provided in the protrusion 2001. The protrusion 2001 is inserted and coupled to the through portion 162 of the first diffuser 160 along the axial direction. Accordingly, the first diffuser 160 and the second diffuser 190 overlap each other along the axial direction, so that an axial length may be shortened. In addition, the occurrence of lateral gap between the first diffuser 160 and the second diffuser 190 may be restricted.

The second diffuser 190 includes a stator coupling portion 195 coupled to the stator 260. The stator coupling portion 195 is provided inside the second diffuser 190.

The stator coupling portion 195 is provided as a plurality of stator coupling portions spaced apart from each other in the circumferential direction of the second diffuser 190. In some implementations, the stator coupling portion 195 is implemented as three stator coupling portions.

The stator coupling portion 195 is disposed to protrude from, for example, an inner surface of the hub 191 of the second diffuser 190.

The stator coupling portion 195 has a radial section 1951 having one end connected to the outer surface of the bearing accommodating portion 2003 and the other end extending in the radial direction.

The stator coupling portion 195 has an axial section 1952 extending along the axial direction from the radial section 1951. The axial section 1952 is configured to protrude from the inner circumferential surface of the hub 191 of the second diffuser 190 in the radial direction and to be disposed along the axial direction.

The radial section 1951 protrudes along the axial direction from the inner surface of the second diffuser 190. The radial section 1951 has, for example, the same height Hr as that of the bearing accommodating portion 2003.

The stator coupling portion 195 includes an outer circumferential surface contact portion 1953 that is in surface contact with the outer circumferential surface of the stator 260 (e.g., the stator core 261).

Each of the outer circumferential surface contact portions 1953 is configured to have, for example, a radius of curvature corresponding to the outer diameter of the stator core 261.

Accordingly, the second diffuser 190 and the stator 260 (e.g., the stator core 261) may be concentrically coupled to each other.

The bearing accommodating portion 2003 of the second diffuser 190 is implemented in a downwardly opened cylindrical shape.

The bearing accommodating portion 2003 of the second diffuser 190 includes the through hole 2002 through which the rotating shaft 291 may pass.

The second diffuser 190 includes a fastening member coupling portion 1956 to communicate with the fastening member insertion hole 163 provided in the first diffuser 160. The fastening member coupling portion 1956 provided in the hub 191 of the second diffuser 190 may be configured such that, for example, the fastening member 165 passing through the fastening member insertion hole 163 of the first diffuser 160 is screwed thereto.

The fastening member coupling portion 1956 of the second diffuser 190 may be disposed, for example, through each of the radial sections 1951 of the stator coupling portion 195.

The stator coupling portion 195 includes an end surface contact portion 1954 in surface contact with one end (e.g., an upper end in the drawing) of the stator 260 along the axial direction. Accordingly, the occurrence of an axial gap between the second diffuser 190 and the stator 260 may be restricted.

The end surface contact portion 1954 is provided in the axial section 1952 of the stator coupling portion 195.

According to this configuration, the stator 260 and the bearing 310 (e.g., the first bearing 310*a*) may be spaced apart from each other by a preset distance along the axial direction.

Accordingly, an increase in the temperature of the bearing 310 provided in the second diffuser 190 due to thermal energy generated by the stator 260 may be restricted.

The end surface contact portion 1954 is disposed to be spaced apart from the lower end of the cylindrical portion 192 of the hub 191 of the second diffuser 190 in the axial direction.

The end surface contact portion 1954 is disposed to be spaced apart from the disk portion 193 of the hub 191 along the axial direction.

As shown in FIG. 9, the axial section 1952 is configured to protrude from the hub 191 of the second diffuser 190 in the axial direction.

For example, the stator coupling portion 195 is configured to protrude downward from the lower end (e.g., a downstream end of the hub 191) of the hub 191 of the second diffuser 190.

The stator coupling portion 195 (e.g., the axial section 1952) includes a fastening member coupling portion 1955 so that the fastening member 335 coupled in the bracket 330 may be screwed therethrough.

The fastening member coupling portion 1955 of the stator coupling portion 195 is disposed at a preset depth along the axial direction from the downstream end of the axial section 1952.

The plurality of blades 198 of the second diffuser 190 are shorter than the plurality of blades 171 of the first diffuser 160.

As shown in FIG. 9, the plurality of blades 198 of the second diffuser 190 are configured such that two blades adjacent to each other in the circumferential direction are spaced apart from each other at preset intervals along the circumferential direction.

For example, among the two blades 198 adjacent to each other, the downstream end of the blade disposed at the rear is disposed to be spaced apart rearward compared to the upstream end of the blade 198 disposed at the front with respect to the rotation direction of the impeller 130.

According to this configuration, the manufacturing of the second diffuser 190 may be facilitated.

Referring to FIGS. 6 and 9 together, the hub 191 of the second diffuser 190 includes a communicating portion 205 allowing the inside and the outside to communicate with each other. Accordingly, the air inside the second diffuser 190 may be discharged to the outside of the second diffuser 190.

According to this configuration, the air inside the second diffuser 190, having a temperature increased by thermal energy generated during operation of the motor 250 (e.g., the stator 260 and the rotor 290), is discharged to the outside of the second diffuser 190 through the communicating portion 205, thereby reducing an internal temperature of the second diffuser 190.

Because the temperature rise of the stator 260 and the rotor 290 is restricted, it may be restricted that power of the motor 250 is inhibited due to an increase in electrical resistance of the stator 260 and the rotor 280 when the temperature of the stator 260 and the rotor 290 increases. It is further restricted that the output of the motor 250 is inhibited due to an increase in electrical resistance of the stator 260 and the rotor 280 when the temperature of the stator 260 and the rotor 290 increases. That is, because the stator 260 and the rotor 290 in some implementations are operated at a relatively low temperature by the air discharge action of the communicating portion 205, the power of the motor 250 may be increased.

The communicating portion 205 may be implemented as a plurality of communication portions spaced apart along the circumferential direction of the second diffuser 190. The communicating portion 205 may be implemented, for example, as two to fifteen communicating portions. In some implementations, nine communicating portions 205 are implemented as illustrated. However, this is only a non-limiting example.

The communicating portion 205 is disposed on the upstream side of each of the plurality of blades 198 of the second diffuser 190.

Figure 10:
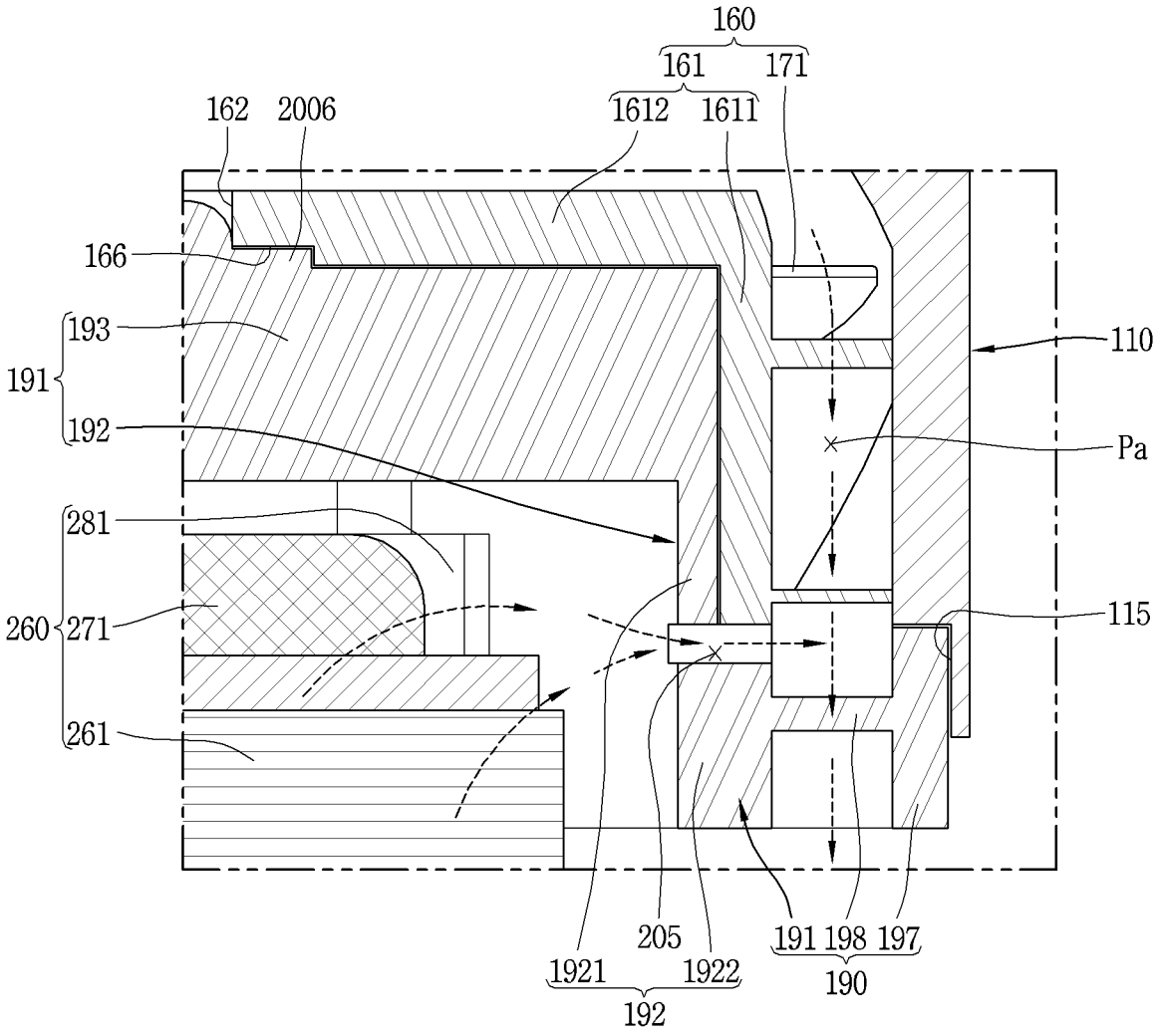
FIG. 10 is an enlarged view of a communicating portion region of FIG. 2.
Figure 11:
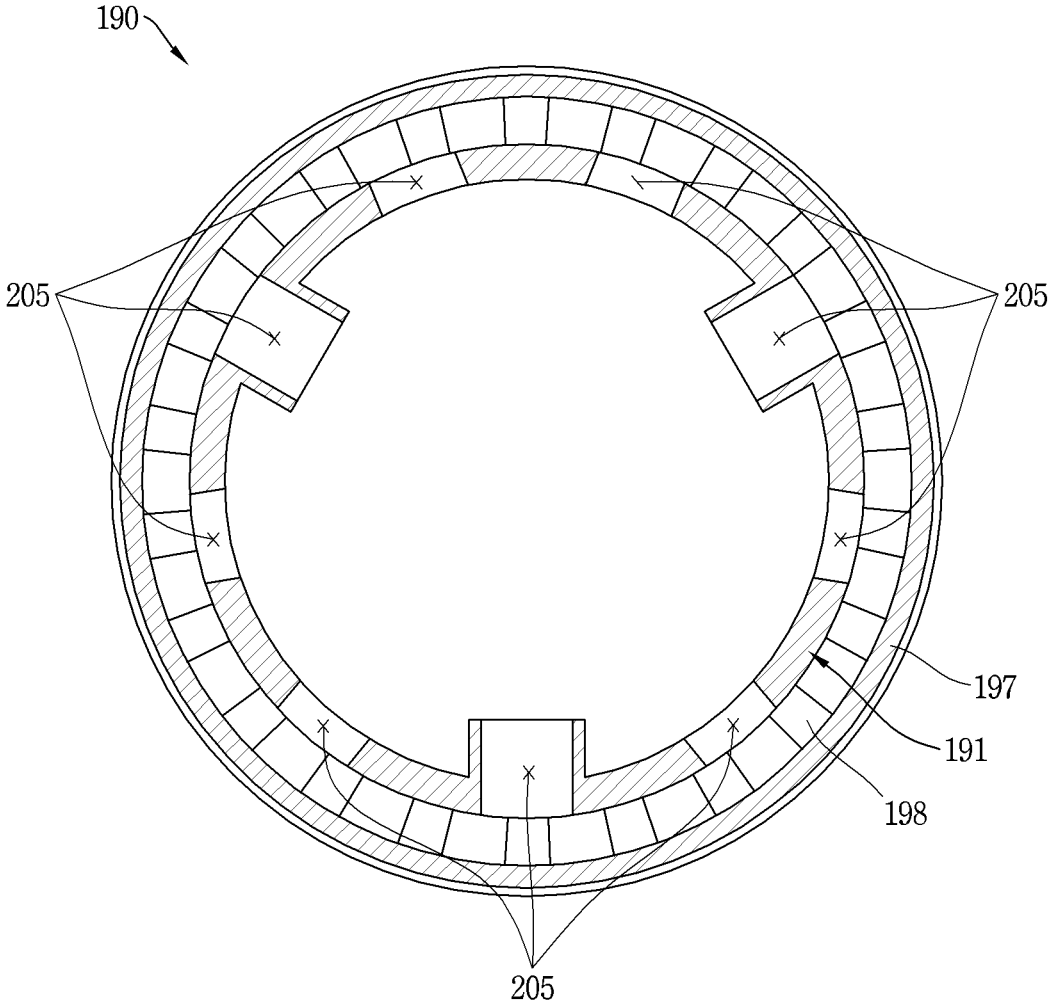
FIG. 11 is a cross-sectional view of the communicating portion region of the second diffuser of FIG. 9.
Figure 12:
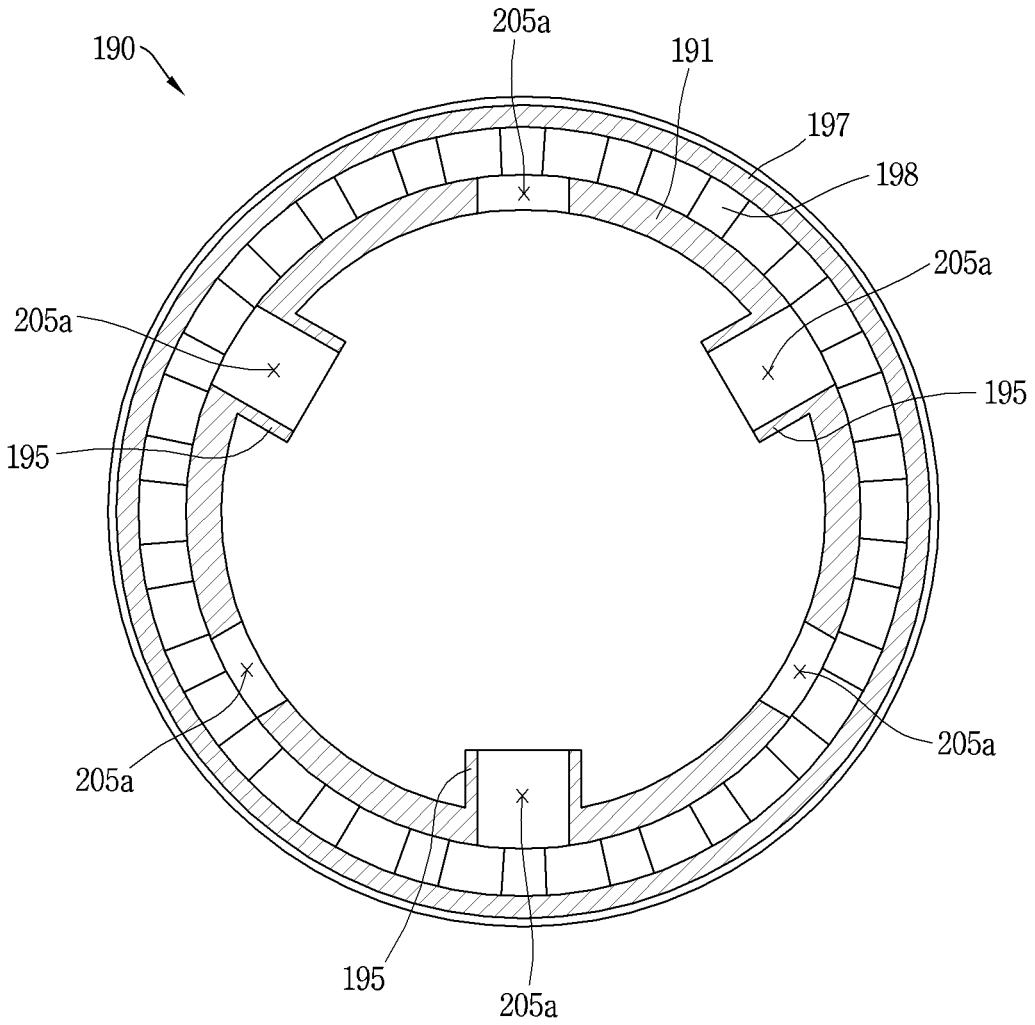
FIG. 12 is a cross-sectional view of a communicating portion region of a second diffuser of a motor assembly according to another implementation of the present disclosure.
Figure 13:
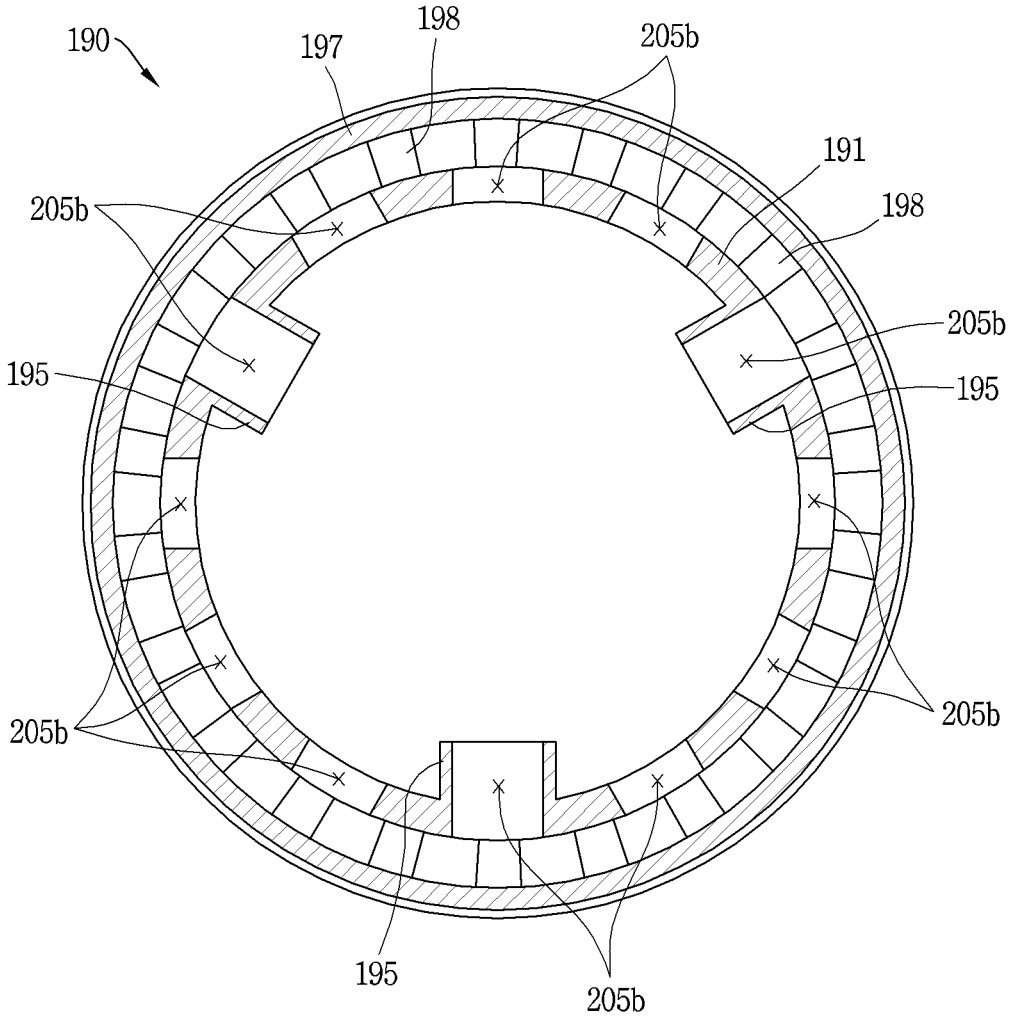
FIG. 13 is a cross-sectional view of a communicating portion region of a second diffuser of a motor assembly according to an implementation of the present disclosure.

FIG. 10 is an enlarged view of a communicating portion region of FIG. 2, FIG. 11 is a cross-sectional view of the communicating portion region of the second diffuser of FIG. 9, FIG. 12 is a cross-sectional view of a communicating portion region of a second diffuser of a motor assembly according to an implementation of the present disclosure, and FIG. 13 is a cross-sectional view of a communicating portion region of a second diffuser of a motor assembly according to an implementation of the present disclosure.

As shown in FIGS. 10 and 11, the communicating portion 205 is disposed to penetrate through the cylindrical portion 192 of the hub 191 of the second diffuser 190 in the radial direction.

The communicating portion 205 may be implemented, for example, in the shape of a long hole having a length longer than a width.

The communicating portion 205 has a length disposed in the circumferential direction of the cylindrical portion 192 of the hub 191 of the second diffuser 190 and has a width disposed in the axial direction of the cylindrical portion 192 of the hub 191.

The communicating portion 205 is disposed on one side (e.g., a lower side in the drawing) of the first diffuser 160 in the axial direction.

The communicating portion 205 is disposed on one side (e.g., a lower side) of the plurality of blades 171 of the first diffuser 160 in the axial direction.

Referring back to FIG. 9, the communicating portion 205 is disposed in the second section 1922 of the cylindrical portion 192 of the second diffuser 190.

Each of the communicating portions 205 is disposed so that the upstream side (e.g., an upper side) is opened along the axial direction.

The open region on the upstream side of the communicating portion 205 is blocked by the downstream end (e.g., a lower end) of the first diffuser 160 when the first diffuser 160 and the second diffuser 190 are coupled.

In some implementations, as described above, the number of communicating portions 205 may be nine. For example, three of the communicating portions 205 may be separately disposed through, for example, the stator coupling portion 195 (e.g., the axial section 1952). Six of the communicating portions 205 may be disposed to penetrate through the cylindrical portion (e.g., the second section 1922) of the hub 191 of the second diffuser 190.

As shown in FIG. 12, the second diffuser 190 may be configured to include six communicating portions 205*a*. In some implementations, three of the six communicating portions 205*a* may be disposed to radially penetrate through the stator coupling portion 195 (e.g., the axial section 1952). Three of the six communicating portions 205 may be disposed to radially penetrate through the hub 191 (e.g., the second section 1922) of the second diffuser 190 to be respectively disposed between the stator coupling portions 195.

Also, as shown in FIG. 13, the second diffuser 190 may include twelve communicating portions 205*b*. Three of the twelve communicating portions 205*b* may be disposed through the stator coupling portion 195. Nine of the twelve communicating portions 205*b* may be configured to be arranged by three each between the stator coupling portions 195.

According to this configuration, when the impeller cover 110, the impeller 130, the first diffuser 160, the second diffuser 190, and the motor 250 are intended to be coupled, the second diffuser 190 is inserted and coupled to the inside of the first diffuser 160 and the bearing 310 (e.g., the first bearing 310*a*) is accommodated and coupled to the bearing accommodating portion 2003 of the second diffuser 190.

The stator 260 may be inserted and coupled to the second diffuser 190 along the axial direction, and the rotor 290 may be inserted and coupled to the inside of the stator 260.

The upper end of the rotating shaft 291 of the rotor 290 is coupled to pass through the first bearing 310*a*, and the impeller 130 is coupled to the upper end of the rotating shaft 291.

The impeller cover 110 is coupled to the outer wall 197 of the second diffuser 190.

The bearing 310 (e.g., the second bearing 310*b*) is coupled to a lower region of the rotating shaft 291 of the rotor 290, and the second bearing 310*b* is inserted and coupled to the bearing accommodating portion 331 of the bracket 330.

The plurality of leg portions 332 of the bracket 330 are respectively fixedly coupled to the stator coupling portion 195 by the fastening member 335.

The connection terminal support portions 282 of the stator 260 are respectively disposed between the plurality of leg portions 332 of the bracket 330, and the PCB 350 is electrically coupled to the connection terminal 283 protruding downward of the bracket 330 along the axial direction. Accordingly, a three-phase AC power may be applied to the stator coil 271.

When the operation is started and power is applied to the stator coil 271, the stator coil 271 generates a magnetic force, and the rotor 290 rotates about the rotating shaft 291 by the interaction of the magnetic force of the permanent magnet 292 and the magnetic force of the stator coil 271.

When the impeller 130 is rotated by the rotation of the rotor 290, air is sucked into the impeller cover 110 through the suction port 112.

The air sucked into the impeller cover 110 is guided by the plurality of blades 171 of the first diffuser 160 and the plurality of blades 198 of the second diffuser 190 along the axial direction and discharged to the downstream side of the second diffuser 190. The discharged air moves downward along the axial direction from the radially outer side of the stator 260.

When the operation is started and the impeller 130 is rotated, the speed of the air on the downstream side of the impeller 130 increases and the pressure decreases. At this time, because an external air flow path Pa of the second diffuser 190 along the radial direction is in a relatively low pressure state, the air inside the hub 191 of the second diffuser 190 flows to the outside of the hub 191 of the second diffuser 190 through the communicating portion 205.

When the impeller 130 rotates, the air inside the hub 191 of the second diffuser 190 continuously flows out through the communicating portion 205, so that air is continuously moved toward the communicating portion 205 via an upper region of the motor 250 (e.g., the stator 260 and the rotor 290). Accordingly, the motor 250 (e.g., the stator 260 and the rotor 290) may be continuously cooled by the air continuously moving toward the communicating portion 205. As a result, the stator 260 and the rotor 290 may maintain a relatively low temperature, and an increase in electrical resistance due to a temperature rise may be restricted, thereby increasing the power of the motor 250.

Figure 14:
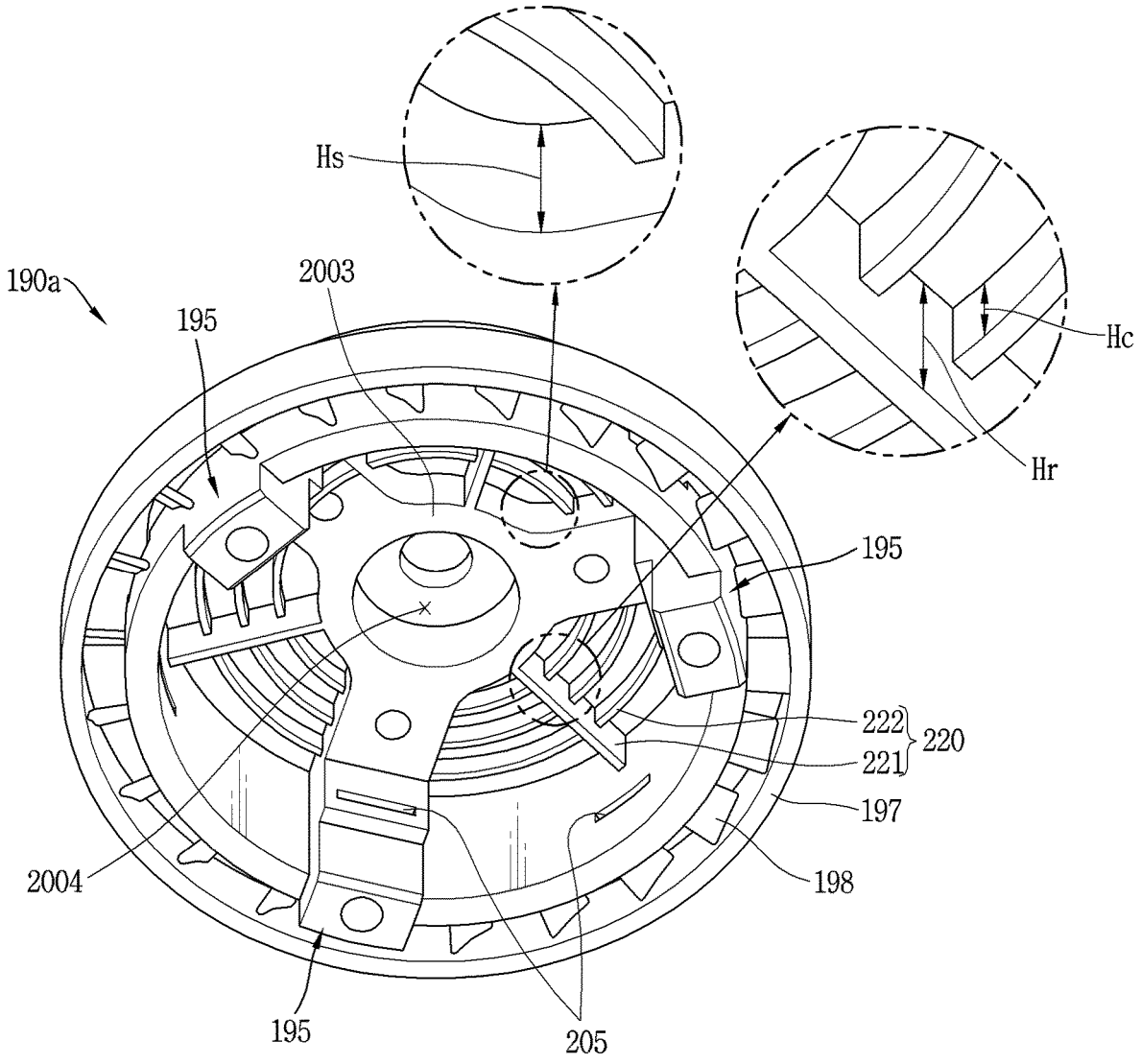
FIG. 14 is a bottom perspective view of a second diffuser of the motor assembly according to an implementation of the present disclosure.

FIG. 14 is a bottom perspective view of a second diffuser of the motor assembly according to an implementation of the present disclosure, and FIGS. 15 to 19 are modified examples of a heat dissipation fin of FIG. 14.

As shown in FIG. 14, a second diffuser 190*a* of the motor assembly according to an implementation of the present disclosure includes a hub 191, an outer wall 197 concentrically disposed on the outside of the hub 191, and a plurality of blades 198 having one end connected to the hub 191 and the other end connected to the outer wall 197 as described above.

The hub 191 of the second diffuser 190*a* includes a bearing accommodating portion 2003 in which the bearing 310 is accommodated.

The second diffuser 190*a* includes a stator coupling portion 195 coupled to the stator 260.

The stator coupling portion 195 includes a radial section 1951 having one end connected to the bearing accommodating portion 2003 and extending in the radial direction and an axial section 1952 extending from the radial section 1951 in the axial direction.

The stator coupling portion 195 includes an outer circumferential surface contact portion 1953 in surface contact with the outer circumference of the stator 260 and an end surface contact portion 1954 in surface contact with one end of the stator 260 along the axial direction.

The second diffuser 190*a* includes a communicating portion 205 allowing the inside and the outside of the hub 191 of the second diffuser 190*a* to communicate with each other.

The second diffuser 190*a* is formed of a metal member. For example, the second diffuser 190*a* is formed of an aluminum (Al) member.

In some implementations, the second diffuser 190*a* includes the protruding heat dissipation fin 220 to increase a surface area.

The heat dissipation fin 220 includes, for example, a radial heat dissipation fin 221 having one end connected to the circumference of the bearing accommodating portion 2003 and the other end extending in the radial direction.

Therefore, heat dissipation of the bearing accommodating portion 2003 may be promoted. In addition, the bearing strength of the bearing accommodating portion 2003 may be improved.

According to this configuration, the occurrence of vibration of the bearing 310 (e.g., the first bearing 310*a*) provided in the bearing accommodating portion 2003 may be restricted. In addition, cooling of the bearing 310 (e.g., the first bearing 310*a*) provided in the bearing accommodating portion 2003 may be promoted.

The radial heat dissipation fin 221 may be respectively disposed between the stator coupling portions 195 along the circumferential direction, for example.

In some implementations, the radial heat dissipation fin 221 may be implemented in three pieces.

The radial heat dissipation fin 221 has the same height as that of the stator coupling portion 195 along the axial direction.

In some implementations, the heat dissipation fin 220 includes a circumferential heat dissipation fin 222 disposed along the circumferential direction on the circumference of the bearing accommodating portion 2003.

Accordingly, heat dissipation of the second diffuser 190*a* may be promoted. In addition, the rigidity of the second diffuser 190*a* may be improved.

According to this configuration, the occurrence of vibration of the bearing 310 (e.g., the first bearing 310*a*) provided in the bearing accommodating portion 2003 may be restricted. In addition, cooling of the bearing 310 (e.g., first bearing 310*a*) provided in the bearing accommodating portion 2003 may be promoted.

The circumferential heat dissipation fin 222 are implemented as a plurality of circumferential heat dissipation fins concentrically arranged around the bearing accommodating portion 2003.

The circumferential heat dissipation fin 222 may be disposed to correspond to the number of the radial heat dissipation fin 221. In some implementations, the circumferential direction heat dissipation fin 222 is implemented as three fins.

For example, a protrusion height Hc protruding from the inner surface of the hub 191 of the circumferential heat dissipation fin 222 in the axial direction is smaller than a protrusion height Hr protruding from the inner surface of the hub 191 of the radial heat dissipation fin 221 in the axial direction.

The radial heat dissipation fin 221 is configured to protrude further from the inner surface of the hub 191 in the axial direction than the circumferential heat dissipation fin 222.

Figure 15:
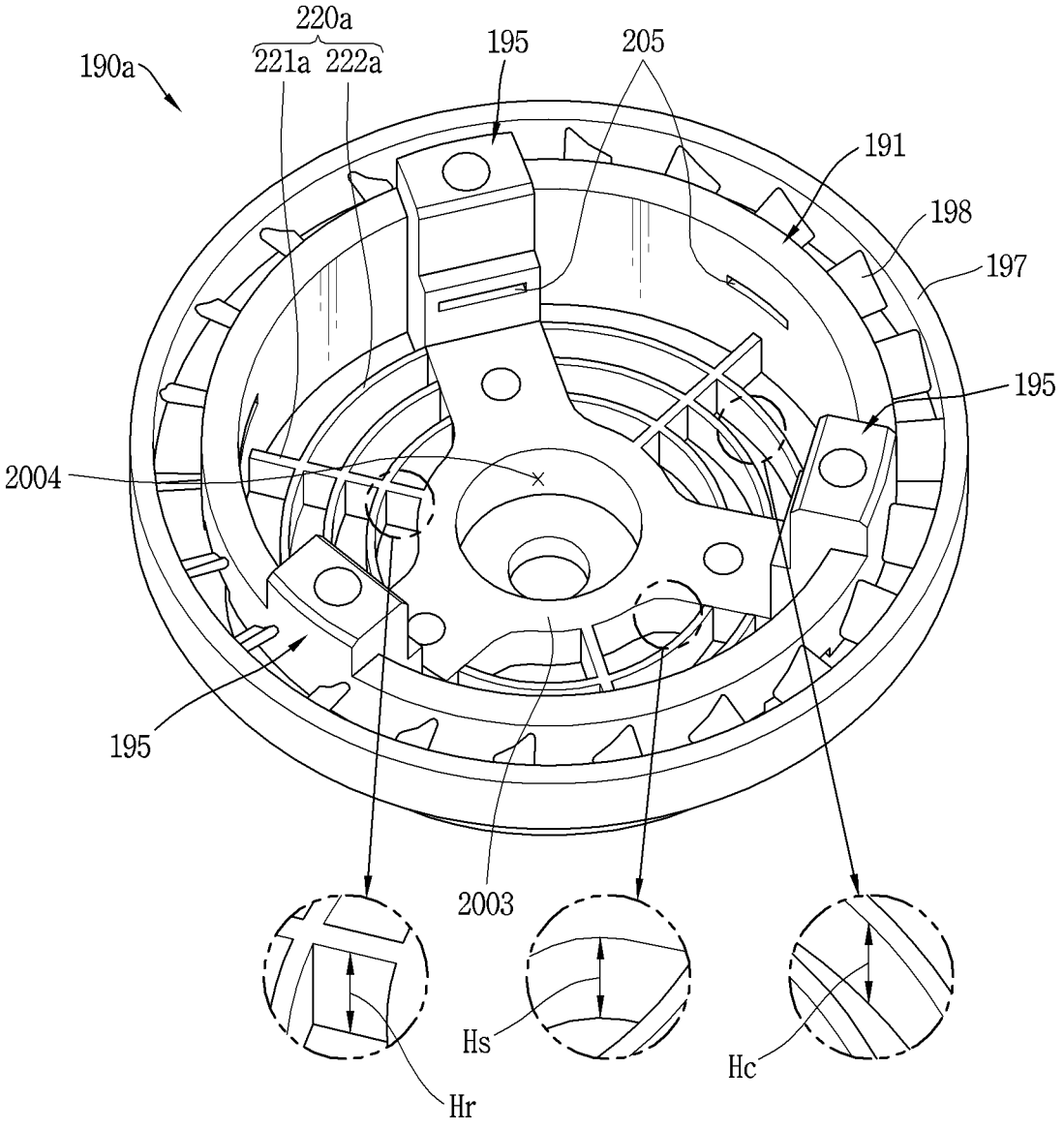
FIGS. 15 to 19 are examples of a heat dissipation fin of FIG. 14.

Here, as shown in FIG. 15, the heat dissipation fin 220*a* in some implementations may include a radial heat dissipation fin 221 and a circumferential heat dissipation fin 222 having the same protrusion height from the inner surface of the hub 191 along the axial direction.

In some implementations, the radial heat dissipation fin 221 and the circumferential heat dissipation fin 222 may be configured to have, for example, the same height as that of the stator coupling portion 195.

Figure 16:
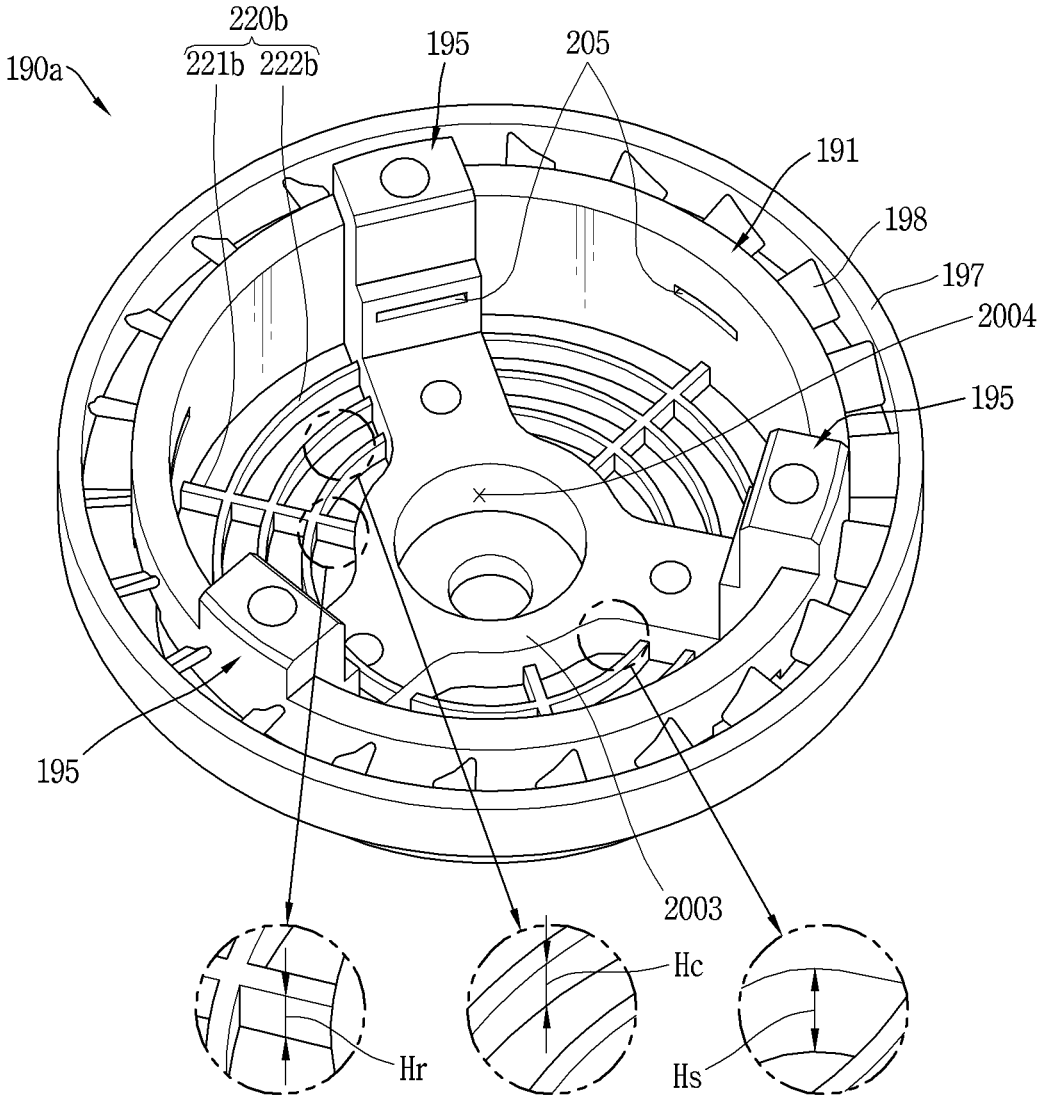

In addition, as shown in FIG. 16, a heat dissipation fin 220*b* in some implementations includes a radial heat dissipation fin 221*b* and a circumferential heat dissipation fin 222*b* respectively protruding from the inner surface of the hub 191 along the axial direction. In some implementations, a protrusion height Hr of the radial heat dissipation fin 221*b* protruding from the disk portion 193 of the hub 191 along the axial direction is equal to a protrusion height Hc of the circumferential heat dissipation fin 222*b*. The protrusion height Hr of the radial heat dissipation fin 221*b* and the protrusion height Hc of the circumferential heat dissipation fin 222*b* have protrusion heights Hr and Hc smaller than the protrusion height Hs of the stator coupling portion 195 protruding from the disk portion 193 of the hub 191 along the axial direction.

The heat dissipation fin 220 may include radial heat dissipation fin 221 and circumferential heat dissipation fin 222 disposed in different numbers.

Figure 17:
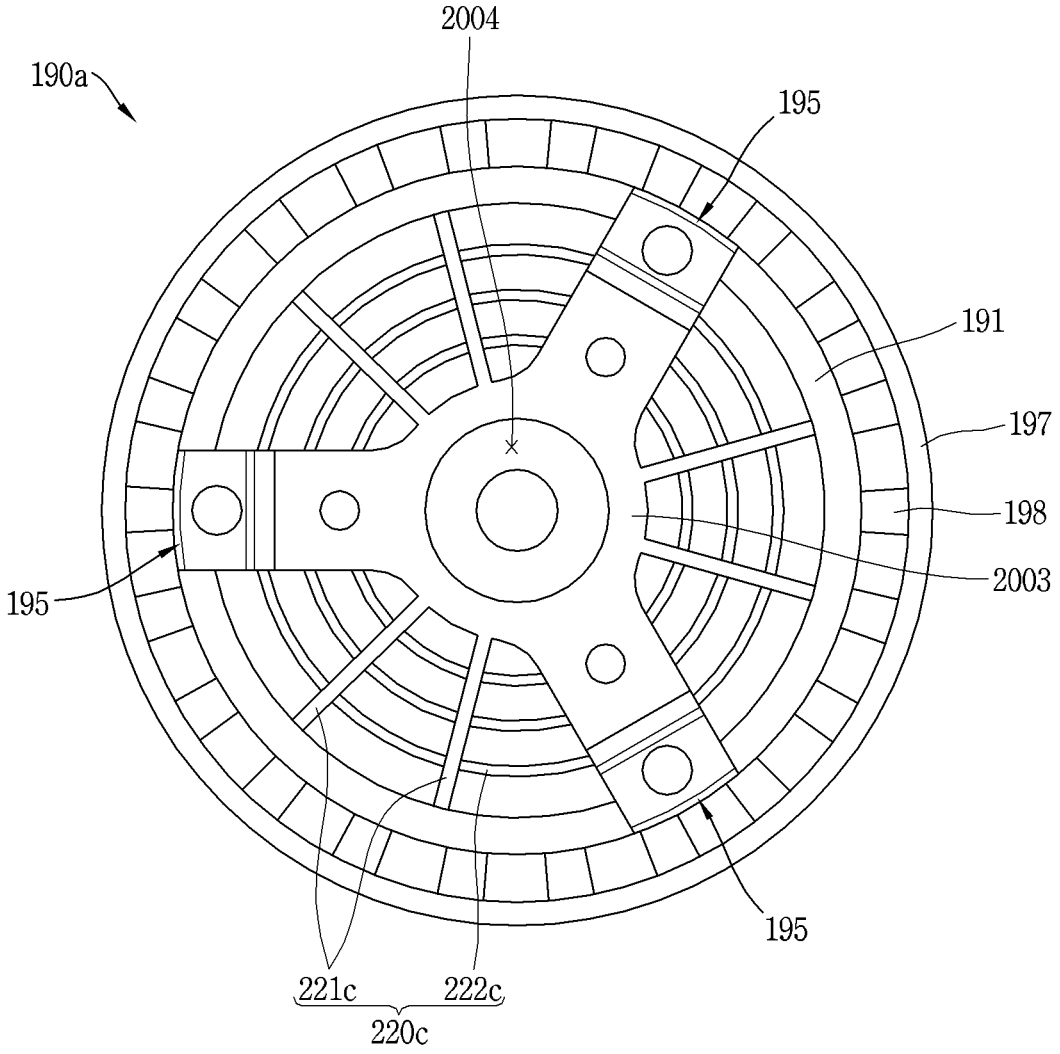

As shown in FIG. 17, the heat dissipation fin 220*c* includes three circumferential heat dissipation fins 222*c* and six radial heat dissipation fins 221*c* embodied therein. In some implementations, the radial heat dissipation fin 221*c* may be configured by two between the stator coupling portions 195 adjacent to each other in the circumferential direction. The circumferential heat dissipation fins 222*c* may be respectively disposed between the radial heat dissipation fins 221*c* in the circumferential direction.

The circumferential heat dissipation fin 222*c* is configured to connect the stator coupling portion 195 and the radial heat dissipation fin 221*c* adjacent to each other along the circumferential direction, or connect two circumferential heat dissipation fins 222*c* adjacent to each other.

Figure 18:
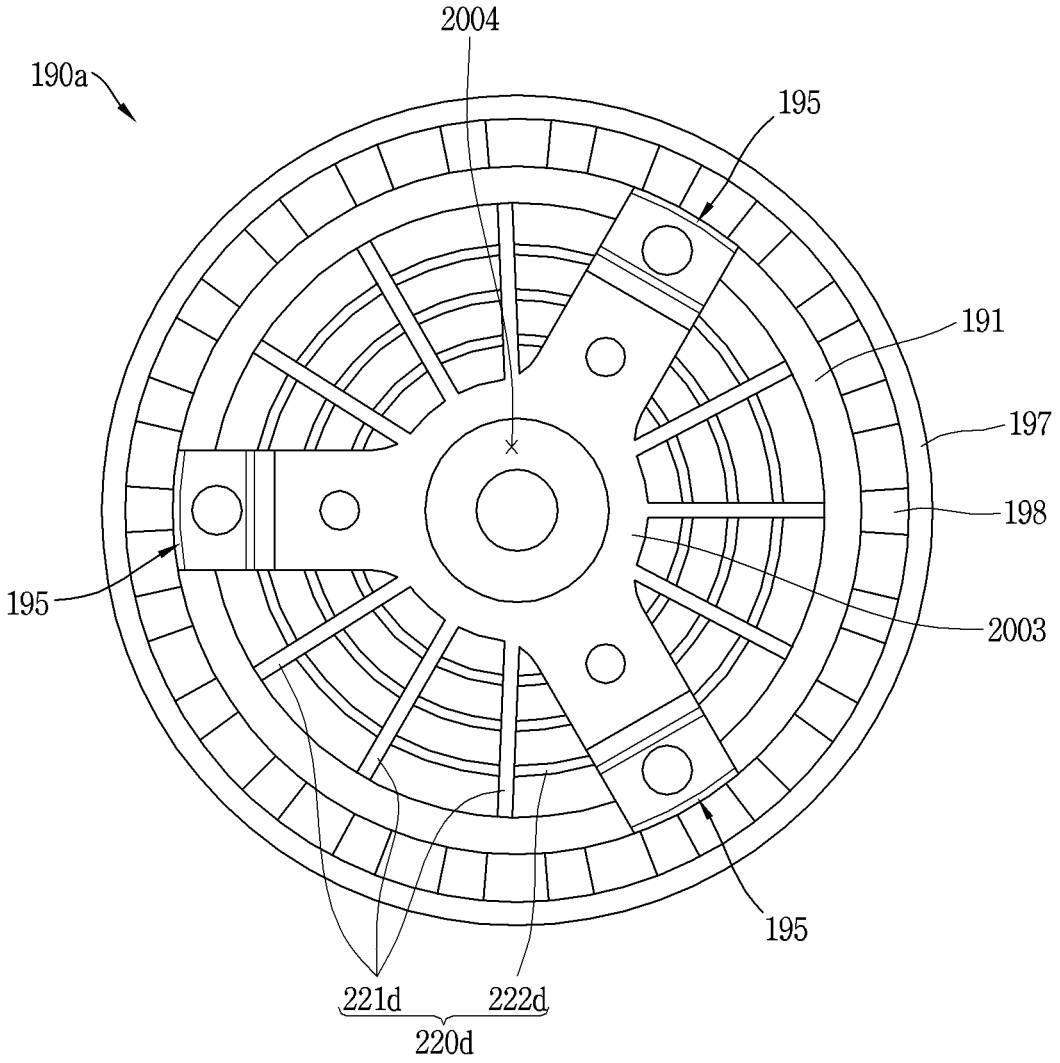

As shown in FIG. 18, a heat dissipation fin 220*d* includes three radial heat dissipation fins 222*d* and nine radial heat dissipation fins 221*d*. In some implementations, the radial heat dissipation fins 221*d* may be configured by three between the two stator coupling portions 195 adjacent to each other in the circumferential direction. Each of the circumferential heat dissipation fins 222*d* may be provided between two radial heat dissipation fins 221*d* adjacent to each other, respectively.

Each of the circumferential heat dissipation fins 222*d* is configured to connect the stator coupling portion 195 and the radial heat dissipation fin 221*d* adjacent to each other, or connect two circumferential heat dissipation fins 222*d* adjacent to each other, respectively.

Figure 19:
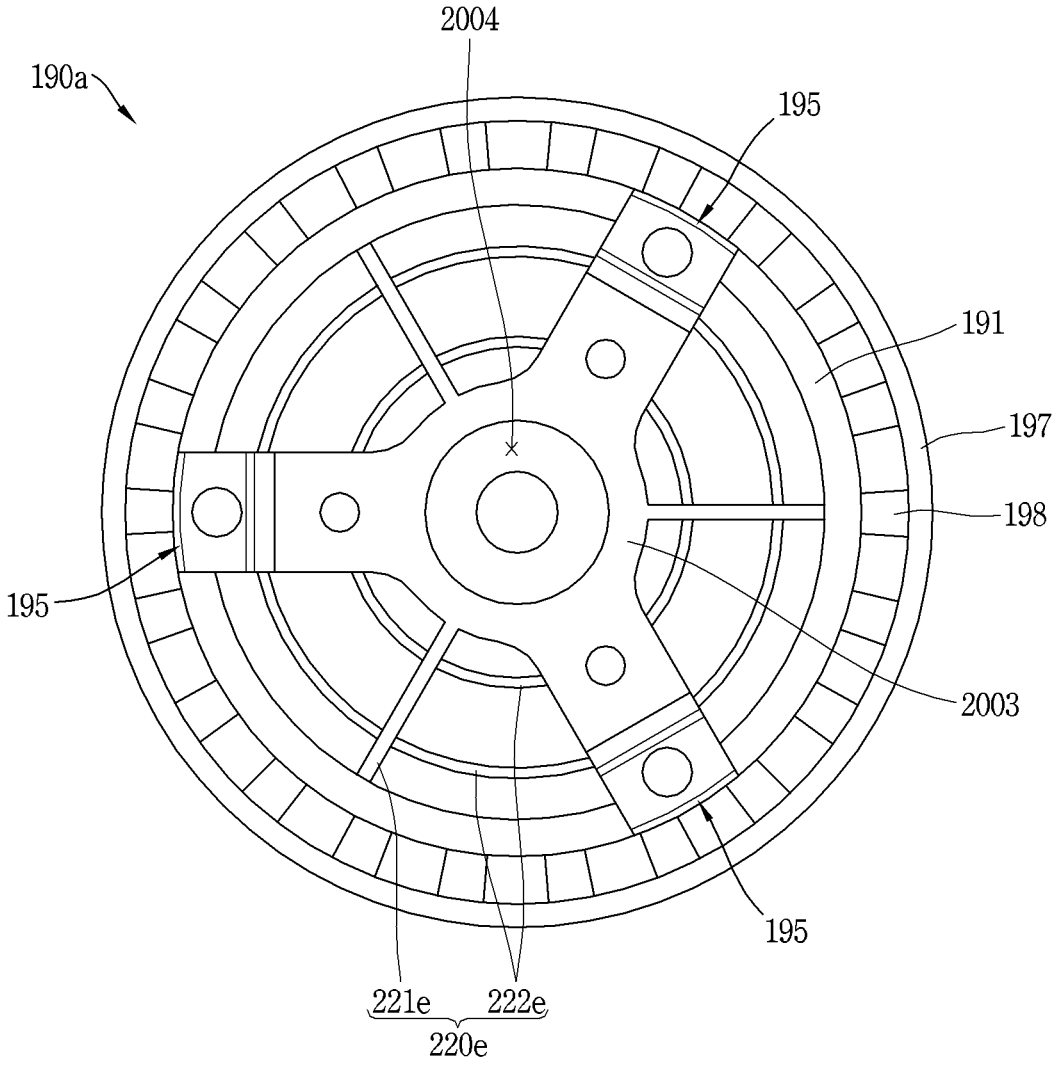

As shown in FIG. 19, a heat dissipation fin 220*e* includes two circumferential heat dissipation fins 222*d* spaced apart from each other in the radial direction around the bearing accommodating portion 2003 and three radial heat dissipation fins 221*d* respectively arranged between two stator coupling portions 195 adjacent to each other.

Each of the circumferential heat dissipation fins 222*d* is configured such that one end is connected to the stator coupling portion 195 and the other end is connected to the radial heat dissipation fin 221*d*.

Figure 20:
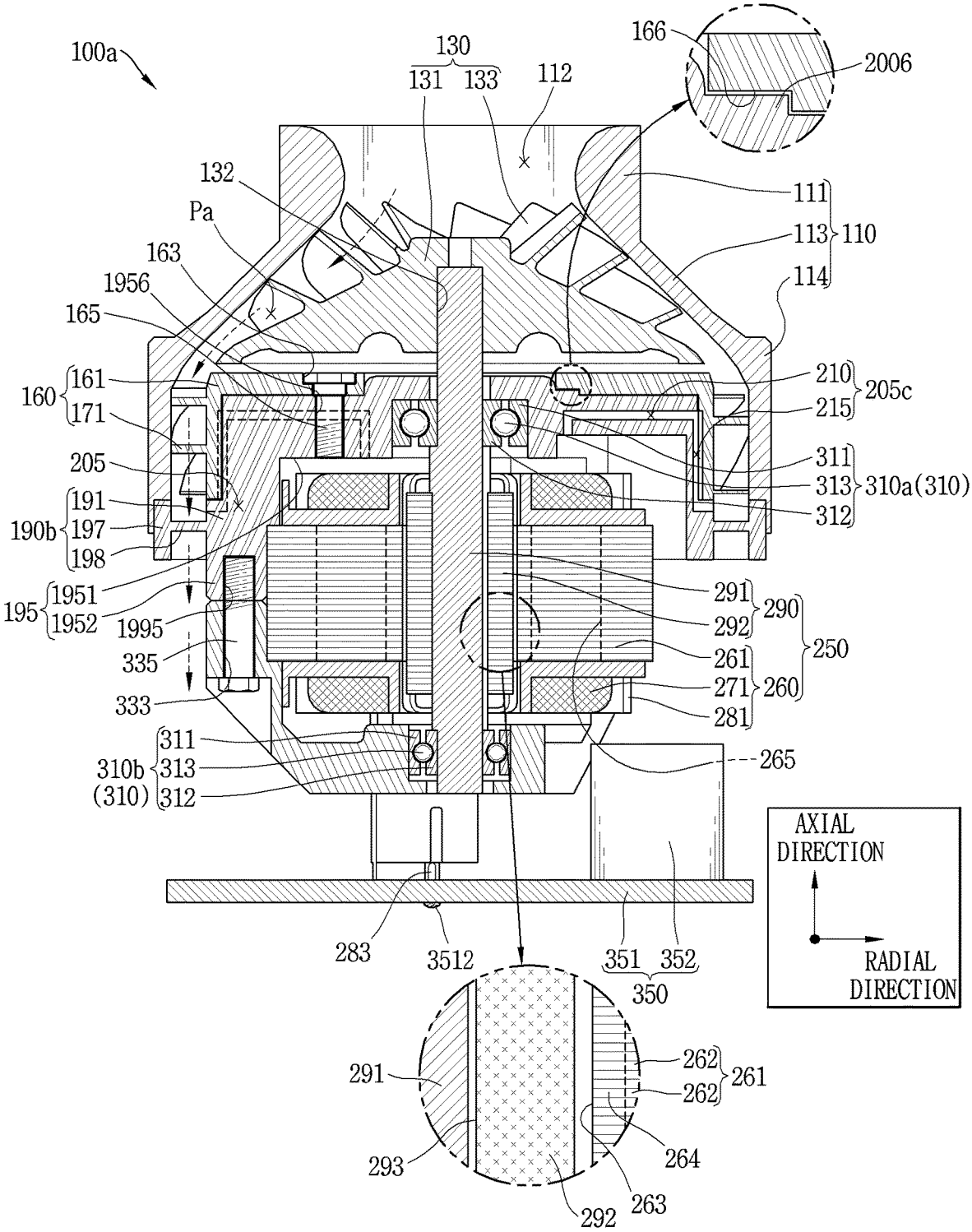
FIG. 20 is a cross-sectional view of a motor assembly according to an implementation of the present disclosure.
Figure 21:
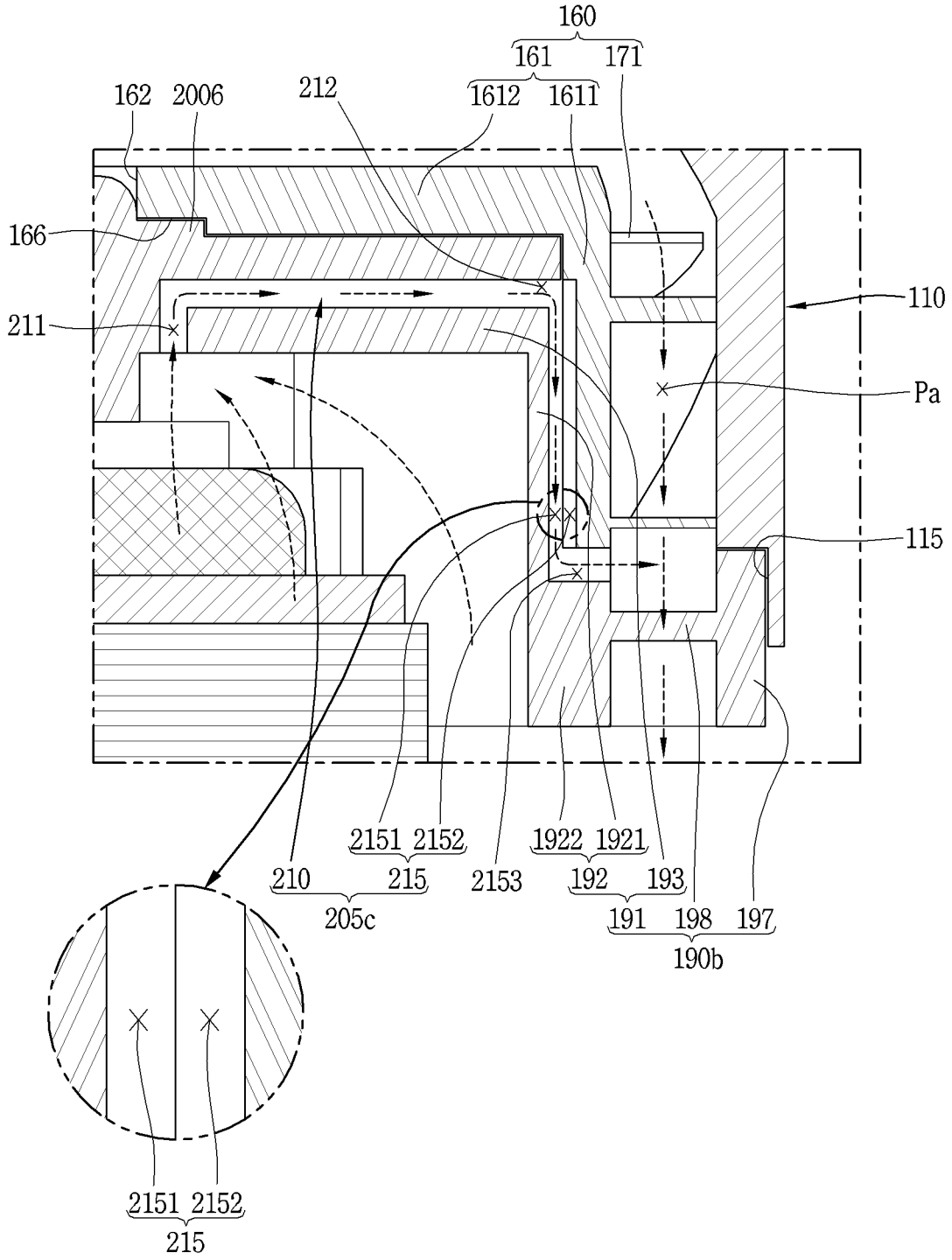
FIG. 21 is an enlarged view of a main part of FIG. 20.

FIG. 20 is a cross-sectional view of a motor assembly according to an implementation of the present disclosure, and FIG. 21 is an enlarged view of a main part of FIG. 20. A motor assembly 100*a* in some implementations includes an impeller 130, an impeller cover 110, a first diffuser 160, a second diffuser 190*b*, and a motor 250.

The impeller cover 110, the impeller 130, the first diffuser 160, the second diffuser 190*b*, and the motor 250 are coupled to each other along the axial direction.

The impeller 130 is accommodated inside the impeller cover 110, and the first diffuser 160 is coupled to a downstream side of the impeller 130. The second diffuser 190*b* is coupled to the first diffuser 160, and the impeller cover 110 is coupled to the second diffuser 190*b* so that the impeller 130 and the first diffuser 160 are accommodated therein.

Here, an air flow path Pa through which the air introduced by the rotation of the impeller 130 moves is disposed between the impeller cover 110, the first diffuser 160, and the second diffuser 190*b*.

The motor 250 is coupled to the second diffuser 190*b*.

The motor 250 has a stator 260 and a rotor 290 that is rotatably accommodated with a predetermined air gap G with respect to the stator 260.

The stator 260 includes a stator core 261 and a stator coil 271 wound around the stator core 261. The stator 260 includes a plurality of connection terminals 283 having one end electrically connected to the stator coil 271 and the other end extending along the axial direction.

The plurality of connection terminals 283 are electrically connected to the PCB 350. The PCB 350 includes a substrate 351 and a plurality of circuit components 352 provided on the substrate 351. The PCB 350 may include, for example, an inverter circuit to provide three-phase AC power to the stator coil 271.

The rotor 290 includes a rotating shaft 291 and a permanent magnet 292 rotating about the rotating shaft 291. The rotating shaft 291 is rotatably supported by a bearing 310. The bearing 310 includes a first bearing 310*a* and a second bearing 310*b* respectively provided on both sides (e.g., upper and lower sides in the drawing) of the permanent magnet 292 along the axial direction. The first bearing 310*a* may have a larger size than that of the second bearing 310*b*.

The impeller 130 includes a hub 131 and a plurality of blades 133 provided around the hub 131.

The first diffuser 160 includes a cylindrical hub 161 and a plurality of blades 171 provided on an outer surface of the hub 161.

Outer ends of the plurality of blades 171 of the first diffuser 160 along the radial direction are disposed to face an inner circumferential surface of the impeller cover 110. For example, the outer ends of the plurality of blades 171 of the first diffuser 160 along the radial direction are configured to contact the inner circumferential surface of the impeller cover 110.

The second diffuser 190*b* includes a cylindrical hub 191, an outer wall 197 concentrically disposed on the outside of the hub 191, and a plurality of blades 198 having one end connected to the hub 191 and the other end connected to the outer wall 197.

The hub 191 of the second diffuser 190*b* is configured to be inserted into the hub 161 of the first diffuser 160.

One of the mutual contact surfaces (e.g., interfacing surfaces) of the first diffuser 160 and the second diffuser 190*b* includes an axially protruding anti-rotation protrusion 2006, and the other includes the anti-rotation protrusion accommodating recess 166 into which the anti-rotation protrusion 2006 is inserted.

The anti-rotation protrusion 2006 is disposed to protrude from the outer surface of the second diffuser 190 in the axial direction, and the anti-rotation protrusion accommodating recess 166 is recessed on the inner surface of the first diffuser 160 along the axial direction.

The hub 191 of the second diffuser 190*b* includes a cylindrical portion 192 and a disk portion 193 disposed to block one end of the cylindrical portion 192 along the axial direction.

The cylindrical portion 192 of the hub 191 of the second diffuser 190*b* includes a first section 1921 inserted into the first diffuser 160 and a second section 1922 protruding to the outside of the first diffuser 160.

The hub 191 (e.g., the disk portion 193) of the second diffuser 190*b* includes a bearing accommodating portion 2003 in which the bearing 310 (e.g., the first bearing 310*a*) is accommodated.

A stator coupling portion 195 to which the stator 260 is coupled is disposed in the second diffuser 190*b*. The stator coupling portion 195 includes a radial section 1951 having one end connected to the bearing accommodating portion 2003 and the other end extending in the radial direction and an axial section 1952 extending from the end of the radial section 1951 along the axial direction.

A bracket 330 accommodating and supporting the bearing 310 (e.g., the second bearing 310*b*) is provided on one side (e.g., a lower side in the drawing) of the motor 250 along the axial direction.

The bracket 330 includes a bearing accommodating portion 331 accommodating the bearing 310 (e.g., the second bearing 310*b*) and a plurality of leg portions 332 having one end connected to the bearing accommodating portion 331 and the other end bent to be disposed along the axial direction. The plurality of leg portions 332 are respectively coupled to the stator coupling portion 195 of the second diffuser 190*b*.

In some implementations, the hub 191 of the second diffuser 190*b* includes a communicating portion 205*c* allowing the inside and the outside of the hub 191 to communicate with each other.

The communicating portion 205*c* includes a radial section 210 disposed to extend outwardly of the cylindrical portion 192 along the radial direction at the disk portion 193 of the hub 191 of the second diffuser 190*b* and an axial section 215 having one side extending from the radial section 210 and the other side extending along the axial direction.

In some implementations, the radial section 210 of the communicating portion 205*c* has an inlet 211 communicating with the inside of the disk portion 193 of the hub of the second diffuser 190*b*.

The radial section 210 of the communicating portion 205*c* has an external opening 212 communicating with the outside of the hub 191.

Therefore, the air inside the hub 191 of the second diffuser 190*b* is moved to the outside of the hub 191 through the inlet 211, the radial section 210, and the external opening 212. In some implementations, the communicating portion 205*c* may be implemented as a plurality of communicating portions spaced apart from each other in the circumferential direction of the second diffuser 190*b*. The communicating portion 205*c* may be disposed, for example, as two to fifteen communicating portions.

In some implementations, some (for example, three) of the plurality of communicating portions 205*c* may be disposed in the stator coupling portion 195.

The axial section 215 includes a first axial section 2151 recessed in the outer surface of the cylindrical portion 192 of the hub 191 of the second diffuser 190*b*.

The first axial section 2151 has an outlet 2153 through which air is discharged. The outlet 2153 is disposed to open outwardly between the plurality of blades 171 of the first diffuser 160 and the plurality of blades 198 of the second diffuser 190*b*.

Accordingly, the air moved to the outside of the hub 191 of the second diffuser 190*b* through the inlet 211 and the radial section 210 is moved along the first axial section 2151 and may flow out to the air flow path Pa through the outlet 2153.

The axial section 215 includes a second axial section 2152 recessed in the inner surface of the hub 191 of the first diffuser 160. The second axial section 2152 forms a flow path through which air moves cooperatively with the first axial section 2151.

In some implementations, the axial section 215 includes both the first axial section 2151 and the second axial section 2152, so that an increase in the thickness of each of the hub 161 of the first diffuser 160 and the hub 191 of the second diffuser 190*b* may be restricted.

The upstream end of the second axial section 2152 is disposed to correspond to the external opening 212 of the radial section 210, and the downstream end extends to the downstream end of the first diffuser 160.

According to this configuration, when the operation is started and power is applied to the stator coil 271, the rotor 290 rotates about the rotating shaft 291 according to interaction between the magnetic force generated by the stator coil 271 and the magnetic force of the permanent magnet 292.

When the rotating shaft 291 is rotated, the impeller 130 is rotated, and air is sucked into the impeller cover 110 through the suction port 112. The sucked air moves to the downstream side along the outside of the motor 250 via the impeller 130, the first diffuser 160, and the second diffuser 190*b*.

When the impeller 130 is rotated, the pressure on the downstream side of the impeller 130 is relatively lowered, and the air heated by the motor 250 present between the second diffuser 190*b* and the motor 250 moves along the inlet 211, the radial section 210, and the axial section 215 and then flows out to the air flow path Pa through the outlet 2153.

Accordingly, a relatively low temperature air around the motor 250 is introduced between the hub 191 of the second diffuser 190*b* and the motor 250, and in this process, the relatively low temperature air and the motor 250 comes into contact with each other, thereby cooling the motor 250.

According to this configuration, when the impeller 130 rotates, the air between the second diffuser 190*b* and the motor 250 continuously flows out of the hub 191 of the second diffuser 190*b* through the communicating portion 205*c*, continuously cooling the motor 250, so that the motor 250 may be operated at a relatively low temperature.

Accordingly, an increase in electrical resistance due to a high temperature of the motor 250 may be restricted, and thus the power of the motor 250 may be improved.

Illustrated and described herein are some specific implementations of the present disclosure. However, the present disclosure may be embodied in various forms, and the implementations described herein should not be limited in carrying out the present disclosure.

What is claimed is:

1. A motor assembly comprising:

an impeller;

a first diffuser provided at a downstream side of the impeller;

a second diffuser provided at a downstream side of the first diffuser;

an impeller cover coupled to the second diffuser and accommodating the impeller and the first diffuser; and a motor provided at a downstream side of the second diffuser and configured to rotate the impeller, wherein the second diffuser includes:

a hub, an outer wall positioned outside the hub and being concentric with the hub, and a plurality of blades, each of the plurality of blades having a first side connected to the hub and a second side connected to the outer wall, wherein the impeller cover is coupled to the outer wall of the second diffuser, and wherein a communicating portion is provided at the hub of the second diffuser and allows an inside of the hub of the second diffuser to be in communication with an outside of the hub of the second diffuser, wherein the communicating portion includes: a radial section having first and second sides, the first side being opened to an inside of the disk portion, and the second side extending to an outside of the cylindrical portion along a radial direction, and an axial section having first and second sides, the first side communicating with the radial section, and the second side extending along the axial direction.

2. The motor assembly of claim 1, wherein the first diffuser includes:

a tubular hub having an open side along an axial direction; and a plurality of blades provided at an outer wall of the tubular hub, and wherein the hub of the second diffuser is inserted and coupled to an inside of the first diffuser, the hub of the second diffuser contacting the tubular hub of the first diffuser.

3. The motor assembly of claim 2, wherein the hub of the second diffuser includes a bearing accommodating portion.

4. The motor assembly of claim 3, wherein the second diffuser includes a material having a higher thermal conductivity than a thermal conductivity of the first diffuser.

5. The motor assembly of claim 3, wherein the second diffuser includes a heat dissipation fin.

6. The motor assembly of claim 5, wherein the heat dissipation fin includes a radial heat dissipation fin having first and second ends, the first end being connected to a circumference of the bearing accommodating portion, and the second end being disposed in a radial direction.

7. The motor assembly of claim 5, wherein the heat dissipation fin includes a circumferential heat dissipation fin disposed along a circumferential direction at an inner surface of the hub of the second diffuser.

8. The motor assembly of claim 5, wherein the motor includes a stator and a rotor rotatably disposed in the stator, and wherein the hub of the second diffuser includes a stator coupling portion coupled to the stator.

9. The motor assembly of claim 8, wherein the stator coupling portion is provided in plurality and the plurality of stator coupling portions are spaced apart from each other along a circumferential direction of the stator, and wherein the stator coupling portion includes an outer circumferential surface contact portion that contacts an outer circumferential surface of the stator.

10. The motor assembly of claim 9, wherein the stator coupling portion includes an end surface contact portion that contacts an end of the stator along the axial direction.

11. The motor assembly of claim 10, wherein the stator coupling portion includes a radial section having first and second ends, the first end being connected to the bearing accommodating portion, and the second end extending in a radial direction.

12. The motor assembly of claim 11, wherein the stator coupling portion has an axial section extending in the axial direction from the radial section, and wherein the outer circumferential surface contact portion is disposed at an inner surface of the axial section.

13. The motor assembly of claim 12, wherein the end surface contact portion is disposed at the axial section and protrudes inward along the radial direction with respect to the outer circumferential surface contact portion.

14. The motor assembly of claim 7, wherein the first diffuser and the second diffuser have a fastener insertion hole penetrating along the axial direction and configured to receive a fastener.

15. The motor assembly of claim 2, wherein the plurality of blades of the first diffuser includes a first blade and a second blade that are adjacent to each other in a circumferential direction, an upstream end of the first blade overlapping a downstream end of the second blade along the axial direction.

16. The motor assembly of claim 15, wherein the plurality of blades of the second diffuser includes a first blade and a second blade that are adjacent to each other in the circumferential direction, an upstream end of the first blade being spaced apart from a downstream end of the second blade in the circumferential direction.

17. The motor assembly of claim 2, wherein a length of the plurality of blades of the second diffuser is shorter than a length of the plurality of blades of the first diffuser.

18. The motor assembly of claim 2, wherein the impeller cover includes:

an impeller accommodating portion that accommodates the impeller;

a suction portion that extends in the axial direction from an upstream end of the impeller accommodating portion and that is configured to suction air; and a first diffuser accommodating portion that extends in the axial direction from a downstream end of the impeller accommodating portion and accommodates the first diffuser.

19. The motor assembly of claim 18, wherein the impeller accommodating portion has a conical shape that corresponds to a shape of the impeller, and wherein the suction portion and the first diffuser accommodating portion have a cylindrical shape.

20. The motor assembly of claim 18, wherein an outer end of the plurality of blades of the first diffuser along a radial direction faces an inner circumferential surface of the first diffuser accommodating portion or contacts the inner circumferential surface of the first diffuser accommodating portion.

21. The motor assembly of claim 2, wherein the tubular hub of the first diffuser includes a through portion that penetrates along the axial direction, and wherein the hub of the second diffuser includes a protrusion that protrudes along the axial direction and is inserted into the through portion.

22. The motor assembly of claim 21, wherein an anti-rotation protrusion protrudes in the axial direction and is provided at one of (i) a first surface of the tubular hub of the first diffuser or (ii) a second surface of the hub of the second diffuser, the first surface contacting the second surface, and wherein an anti-rotation protrusion accommodating recess is provided at the other of the first surface or the second surface and accommodates the anti-rotation protrusion.

23. The motor assembly of claim 21, wherein a bearing accommodating portion is provided at a rear surface of the protrusion of the second diffuser and accommodates a bearing.

24. The motor assembly of claim 2, wherein the hub of the second diffuser includes a cylindrical portion and a disk portion, the disk portion blocking an end of the cylindrical portion.

25. The motor assembly of claim 24, wherein the axial section includes:

a first axial section recessed in an outer surface of the second diffuser and being in fluid communication with the radial section; and/or a second axial section being in fluid communication with the radial section and recessed in an inner surface of the tubular hub of the first diffuser.

* * * * *